US009192810B2

(12) United States Patent
Beard et al.

(10) Patent No.: US 9,192,810 B2
(45) Date of Patent: Nov. 24, 2015

(54) APPARATUS, SYSTEM, AND METHOD FOR PROVIDING RESISTANCE IN A DUAL TREAD TREADMILL

(71) Applicants: David Beard, Santa Ana, CA (US); Kevin Corbalis, Tustin, CA (US); Victor Cornejo, Riverside, CA (US); Steve Neill, Simi Valley, CA (US); Jeremy Johnson, Corona, CA (US); Jeff Lassegard, Aliso Viejo, CA (US)

(72) Inventors: David Beard, Santa Ana, CA (US); Kevin Corbalis, Tustin, CA (US); Victor Cornejo, Riverside, CA (US); Steve Neill, Simi Valley, CA (US); Jeremy Johnson, Corona, CA (US); Jeff Lassegard, Aliso Viejo, CA (US)

( * ) Notice: Subject to any disclaimer, the term of this patent is extended or adjusted under 35 U.S.C. 154(b) by 142 days.

(21) Appl. No.: 13/796,921

(22) Filed: Mar. 12, 2013

(65) Prior Publication Data

US 2014/0274576 A1 Sep. 18, 2014

Related U.S. Application Data

(60) Provisional application No. 60/609,921, filed on Sep. 14, 2004.

(51) Int. Cl.

| | |
|---|---|
| ***A63B 22/02*** | (2006.01) |
| ***A63B 22/00*** | (2006.01) |
| ***A63B 24/00*** | (2006.01) |
| *A63B 21/005* | (2006.01) |
| *A63B 21/00* | (2006.01) |
| *A63B 21/22* | (2006.01) |
| *A63B 71/06* | (2006.01) |

(52) U.S. Cl.

CPC ..... *A63B 22/0235* (2013.01); *A63B 21/157* (2013.01); *A63B 22/0056* (2013.01); *A63B 24/0087* (2013.01); *A63B 21/005* (2013.01); *A63B 21/0053* (2013.01); *A63B 21/154* (2013.01); *A63B 21/225* (2013.01); *A63B 2021/0055* (2013.01); *A63B 2022/0292* (2013.01); *A63B 2024/0081* (2013.01); *A63B 2024/0093* (2013.01); *A63B 2071/0652* (2013.01); *A63B 2220/16* (2013.01); *A63B 2220/805* (2013.01); *A63B 2225/20* (2013.01); *A63B 2230/062* (2013.01)

(58) Field of Classification Search

CPC ..... A63B 2022/0292; A63B 2022/067; A63B 21/0053; A63B 22/0056; A63B 22/0664; A63B 24/0087; A63B 2022/0017; A63B 2022/0038

USPC ..... 482/51, 54, 1–8

See application file for complete search history.

(56) References Cited

U.S. PATENT DOCUMENTS

| | | | | | |
|---|---|---|---|---|---|
| 4,204,673 | A | * | 5/1980 | Speer, Sr. | 482/5 |
| 5,243,224 | A | * | 9/1993 | Tagney, Jr. | 290/1 R |
| 5,252,859 | A | * | 10/1993 | Tagney, Jr. | 290/1 R |
| 5,256,117 | A | * | 10/1993 | Potts et al. | 482/52 |
| 5,318,491 | A | * | 6/1994 | Houston | 482/54 |
| RE34,959 | E | * | 5/1995 | Potts | 482/52 |
| 5,514,053 | A | * | 5/1996 | Hawkins et al. | 482/63 |
| 5,738,611 | A | * | 4/1998 | Ehrenfried et al. | 482/6 |
| 7,731,636 | B2 | * | 6/2010 | Lull et al. | 482/52 |
| 7,815,549 | B2 | * | 10/2010 | Crawford et al. | 482/52 |
| 8,002,674 | B2 | * | 8/2011 | Piaget et al. | 482/52 |

(Continued)

*Primary Examiner* — Stephen Crow

(74) *Attorney, Agent, or Firm* — Kerry W. Brown

(57) ABSTRACT

A dual treadle treadmill. The dual treadle treadmill includes a frame, a first treadle, a second treadle, and a generator. The first treadle and the second treadle are each pivotally coupled with the frame and each have a moving surface. The generator is operably associated with the first treadle such that the generator is driven in response to the first treadle pivoting relative to the frame. Other embodiments of dual treadle treadmills are also described.

16 Claims, 18 Drawing Sheets

(56) References Cited

U.S. PATENT DOCUMENTS

2003/0004036 A1* 1/2003 Yoss ..... 482/51
2003/0166434 A1* 9/2003 Lopez-Santillana et al. ... 482/52
2004/0077465 A1* 4/2004 Schmidt ..... 482/57
2005/0009668 A1* 1/2005 Savettiere et al. ..... 482/66
2010/0144496 A1* 6/2010 Schmidt ..... 482/70
2014/0274576 A1* 9/2014 Beard et al. ..... 482/54

* cited by examiner

APPARATUS, SYSTEM, AND METHOD FOR PROVIDING RESISTANCE IN A DUAL TREAD TREADMILL

CROSS-REFERENCE TO RELATED APPLICATIONS

This application claims the benefit of U.S. Provisional Patent Application No. 61/609,921 entitled "Apparatus, System, and Method for Providing Resistance in a Dual Tread Treadmill," which was filed on Mar. 12, 2012, and is hereby incorporated by reference.

BACKGROUND

Dual treadle treadmills provide two moving surfaces that articulate relative to each other. These dual treadle treadmills provide both a treadmill-like motion and a stair climber-like motion. This combination of motions provides an exercise that simulates climbing a flight of stairs and provides similar health benefits to users. Existing dual treadmills include several drawbacks, such as unnatural motions that result from existing mechanisms for operating dual treadle treadmills.

SUMMARY

An embodiment of the invention provides a dual treadle treadmill. The dual treadle treadmill includes a frame, a first treadle, a second treadle, and a generator. The first treadle and the second treadle are each pivotally coupled with the frame and each have a moving surface. The generator is operably associated with the first treadle such that the generator is driven in response to the first treadle pivoting relative to the frame. Other embodiments of dual treadle treadmills are also described.

BRIEF DESCRIPTION OF THE SEVERAL VIEWS OF THE DRAWINGS

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

While many embodiments are described herein, at least some of the described embodiments provide a method for providing resistance in a dual tread treadmill.

Figure 1:
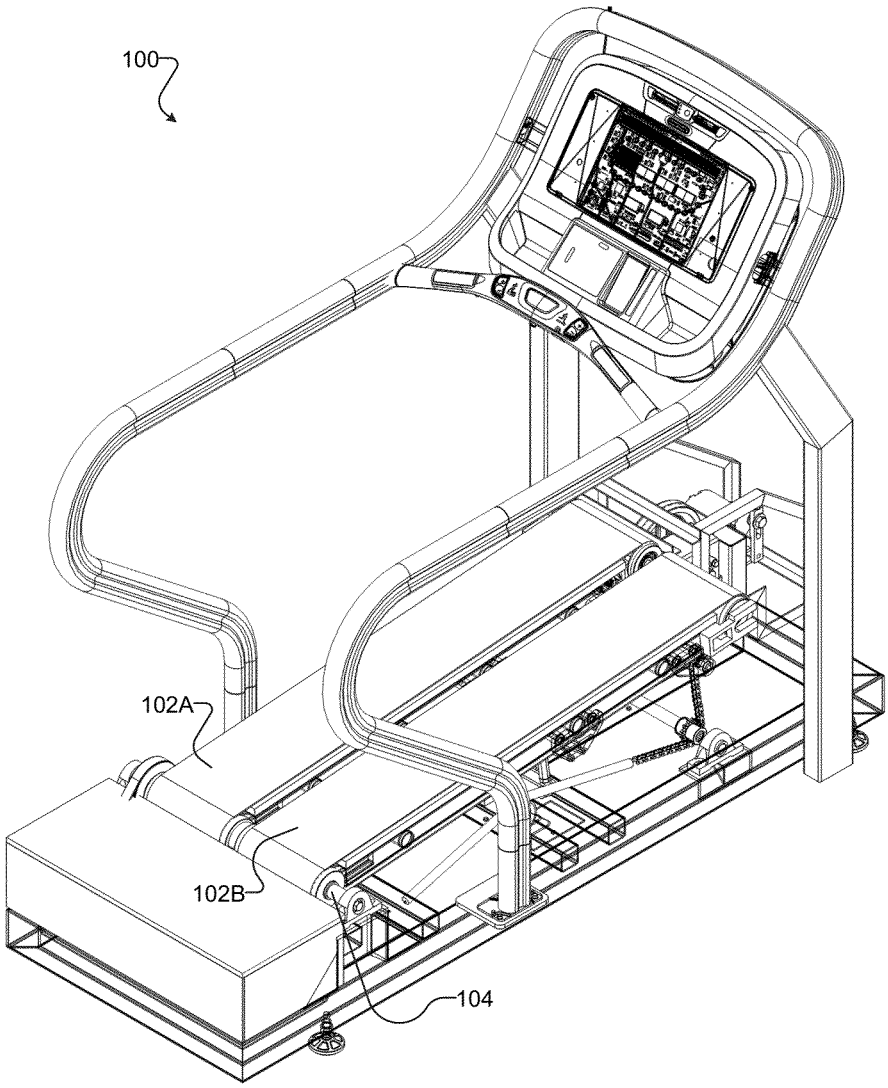
FIG. 1 depicts a perspective view of one embodiment of a dual tread treadmill.

FIG. 1 depicts a perspective view of one embodiment of a dual tread treadmill 100. The dual tread treadmill 100 includes two treadles 102A, 102B (collectively referred to as "the treadles" 102) and an axle 104. In the illustrated embodiment, some components have been removed for clarity. The dual tread treadmill 100 provides a separate pathway for the travel of each foot of a user.

In some embodiments, the treadles 102 articulate around the axle 104. The treadles 102 may articulate independently. As the treadles 102 articulate around the axle 104, an end of each treadle 102 may move in a substantially upward direction or a substantially downward direction. In some embodiments, the treadles 102 are synchronized such that when the first treadle 102A is at its highest position, the second treadle 102B is at its lowest position. Motion of the first treadle 102A may be linked to motion of the second treadle 102B, such that in response to an end of the first treadle 102A moving in a substantially downward direction, an end of the second treadle 102B moves in a substantially upward direction.

Each of the treadles 102A, 102B, in some embodiments, include a moving surface on which a user may step. The moving surface of a treadle, in some embodiments, includes a belt that translates along a top surface of the treadle. In one embodiment, the articulated treadles 102 provide a stair stepping motion for a user, in addition to a treadmill motion.

Figure 2:
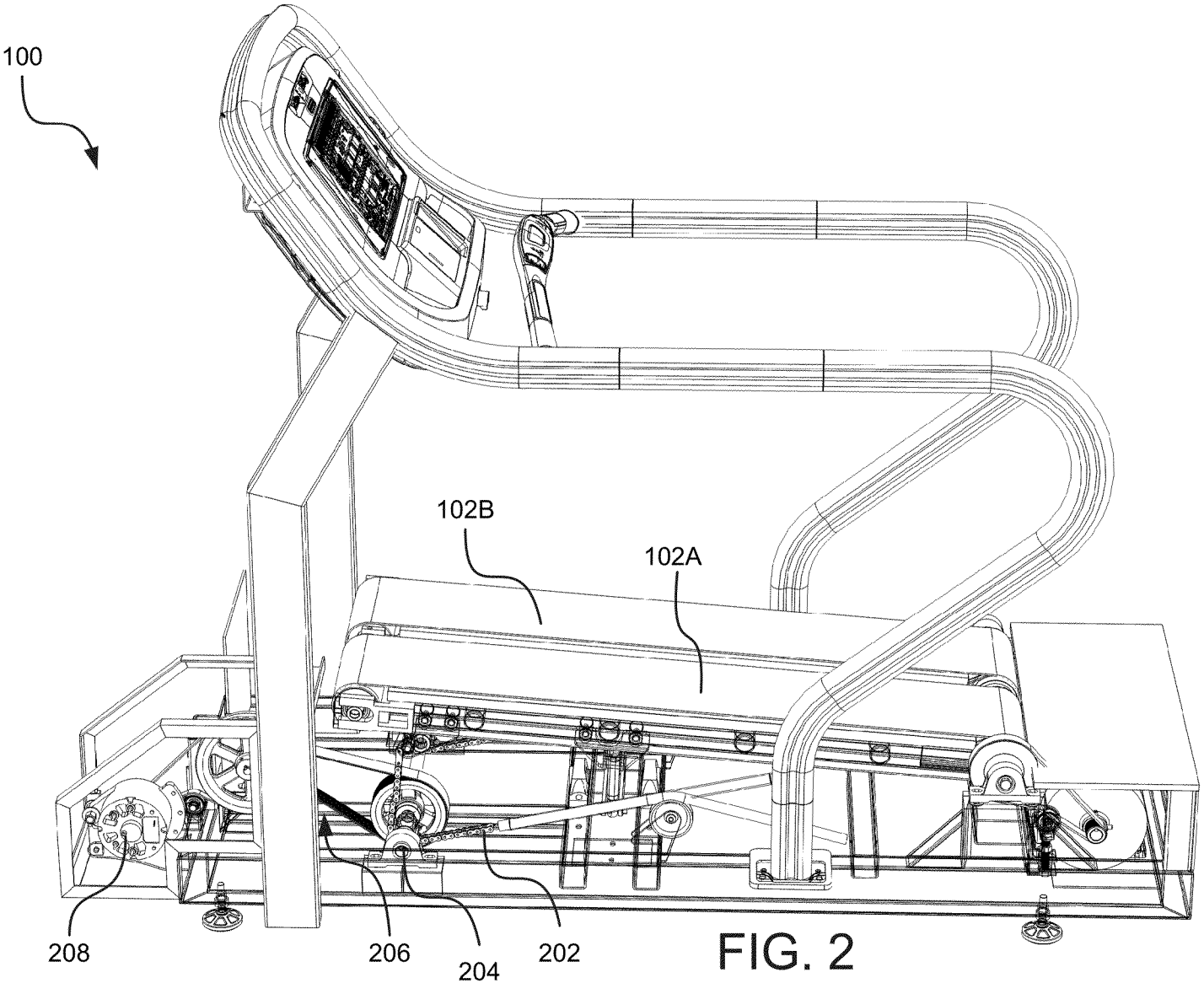
FIG. 2 depicts a perspective view of one embodiment of the dual tread treadmill of FIG. 1.

FIG. 2 depicts a perspective view of one embodiment of the dual tread treadmill 100 of FIG. 1. The dual tread treadmill 100 includes two treadles 102, a drive link 202A, a clutch axle 204, a pulley system 206, and a generator 208. In some embodiments, the drive link 202A, clutch axle 204, pulley system 206, and generator 208 manage a fall rate of the treadles 102.

The drive link 202A, in one embodiment, is connected to one of the treadles 102 (e.g. 102A). The drive link 202A may move in response to movement of the connected treadle 102. In some embodiments, one end of the drive link 202A moves in an upward direction as the connected treadle 102 moves in an upward direction. The drive link 202A may be held in tension by an attached drive link tensioner. The drive link 202A and drive link tensioner are described in relation to FIG. 3 below.

As will be appreciated by one skilled in the art, the dual tread treadmill 100 may include a first drive link 202A attached to the first treadle 102A and a second drive link attached to the second treadle 102B. The two drive links may work in concert to manage the fall rate of the treadles 102.

In certain embodiments, the drive link 202A engages a driver on the clutch axle 204. Motion of the drive link 202A may cause the driver on the clutch axle 204 to rotate. In some embodiments, the driver is attached to the clutch axle 204 by a one-way clutch that causes the clutch axle 204 to rotate in one direction as the drive link 202A moves up and down. The driver and the clutch axle 204 are described in greater detail below.

The pulley system 206 receives rotational motion from the clutch axle 204 and translates the rotational motion to the generator 208. The pulley system 206 may include pulleys of varying sizes that provide a gear ratio. The gear ratio of the pulley system 206 may increase or decrease the rate of rotation provided by the clutch axle 204. In one embodiment, the gear ratio of the pulley system 206 causes the rate of rotation at the output of the pulley system 206 to be increased to a rate above the rate of rotation provided by the clutch axle 204. The pulley system is described in greater detail below in relation to FIG. 4.

In some embodiments, the generator 208 receives rotation from the pulley system 206 and converts the rotation to electrical energy. The generator 208 may also provide a braking torque that resists the rotation from the pulley system 206. This braking torque may be translated through the pulley system 206, the clutch axle, and the drive link 202A to the treadles 102. The translated braking torque may be used by the dual tread treadmill 100 to manage a fall rate of the treadles 102.

The generator 208 may be any type of generator known in the art. For example, the generator 208 may be an alternator, a dynamo, a singly-fed generator, a doubly-fed generator, or another type of generator.

In some embodiments, the generator 208 may be connected to a variable electrical load device. The variable electrical load device applies a variable electrical load to the generator 208. Applying an electrical load to the generator 208 may have a braking effect on the generator 208 to increase the braking torque provided by the generator 208, thus reducing the fall rate of the treadles 102. The variable electrical load device is described in greater detail below in relation to FIG. 9.

Figure 3:
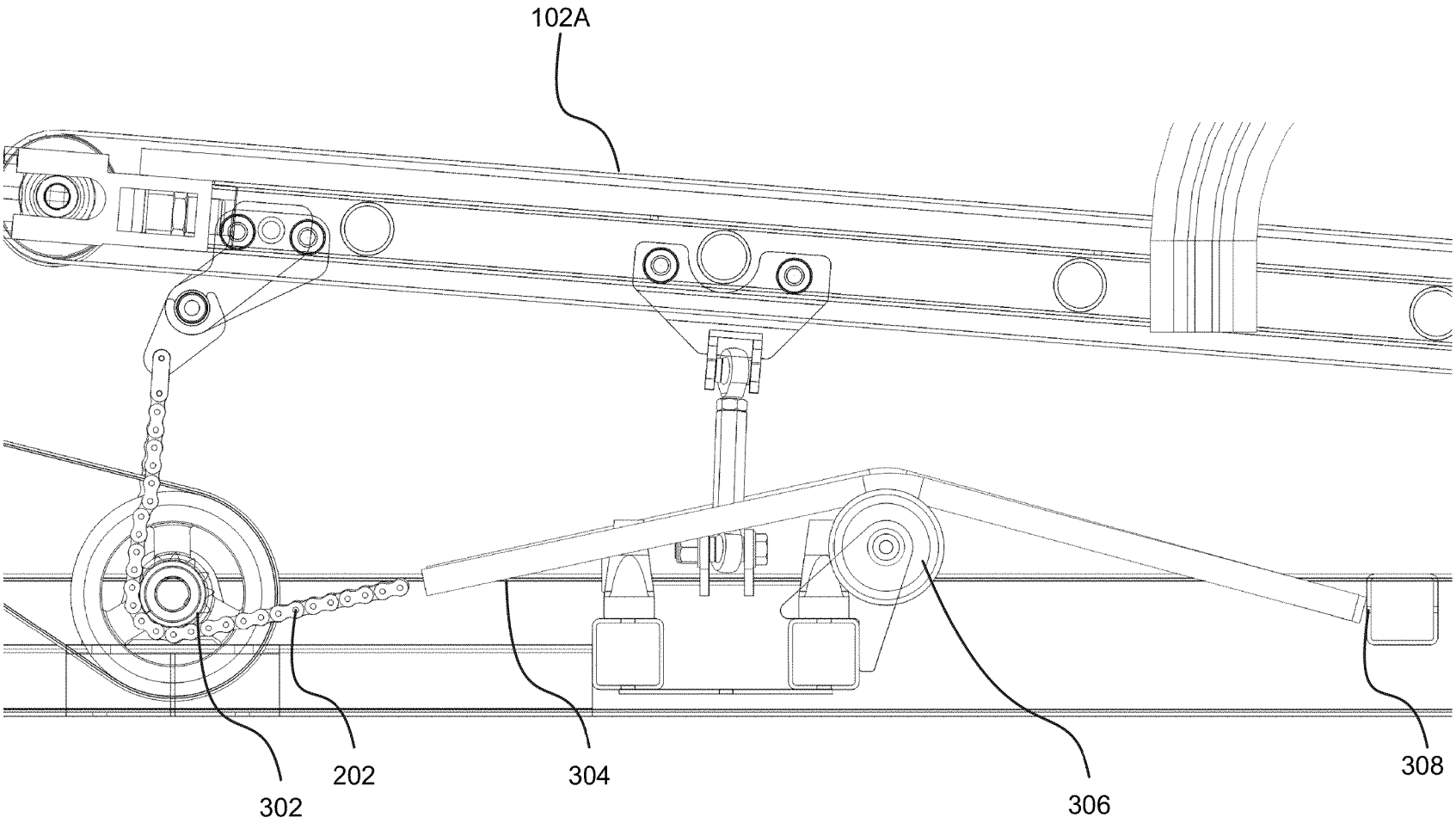
FIG. 3 depicts a side view of one embodiment of the drive link and drive link tensioner of FIG. 2.

FIG. 3 depicts a side view of one embodiment of the drive link 202A and a drive link tensioner 304 of FIG. 2. The drive link 202A, in one embodiment, is connected at one end to a treadle 102. Upward and downward motion of the end of the treadle 102A causes a corresponding upward and downward motion of the attached end of the drive link 202A.

The drive link 202A may be any type of link known in the art. For example, the drive link 202A in one embodiment is a roller chain. In alternative embodiments, the drive link 202A may be a different type of motion translation device. For example, the drive link 202A may be a cable, a rope, a toothed strap, a toothed belt, or a belt.

In some embodiments, the drive link 202A passes over a clutch driver 302. The clutch driver 302 may rotate around the clutch axle 204 in response to motion of the drive link 202A.

The drive link 202A may be held in tension by a drive link tensioner 304. In one embodiment, the drive link tensioner 304 attaches to a second end of the drive link 202A and applies tension to the drive link 202A. Tension in the drive link may act to keep the drive link engaged with the clutch driver 302 as the drive link 202A moves.

The drive link tensioner 304 may be any type of tension device known in the art. For example, the drive link tensioner 304 may be a coil spring. The drive link tensioner may pass over a pulley 306 and be connected to a frame of the dual tread treadmill at an anchor point 308.

Figure 4:
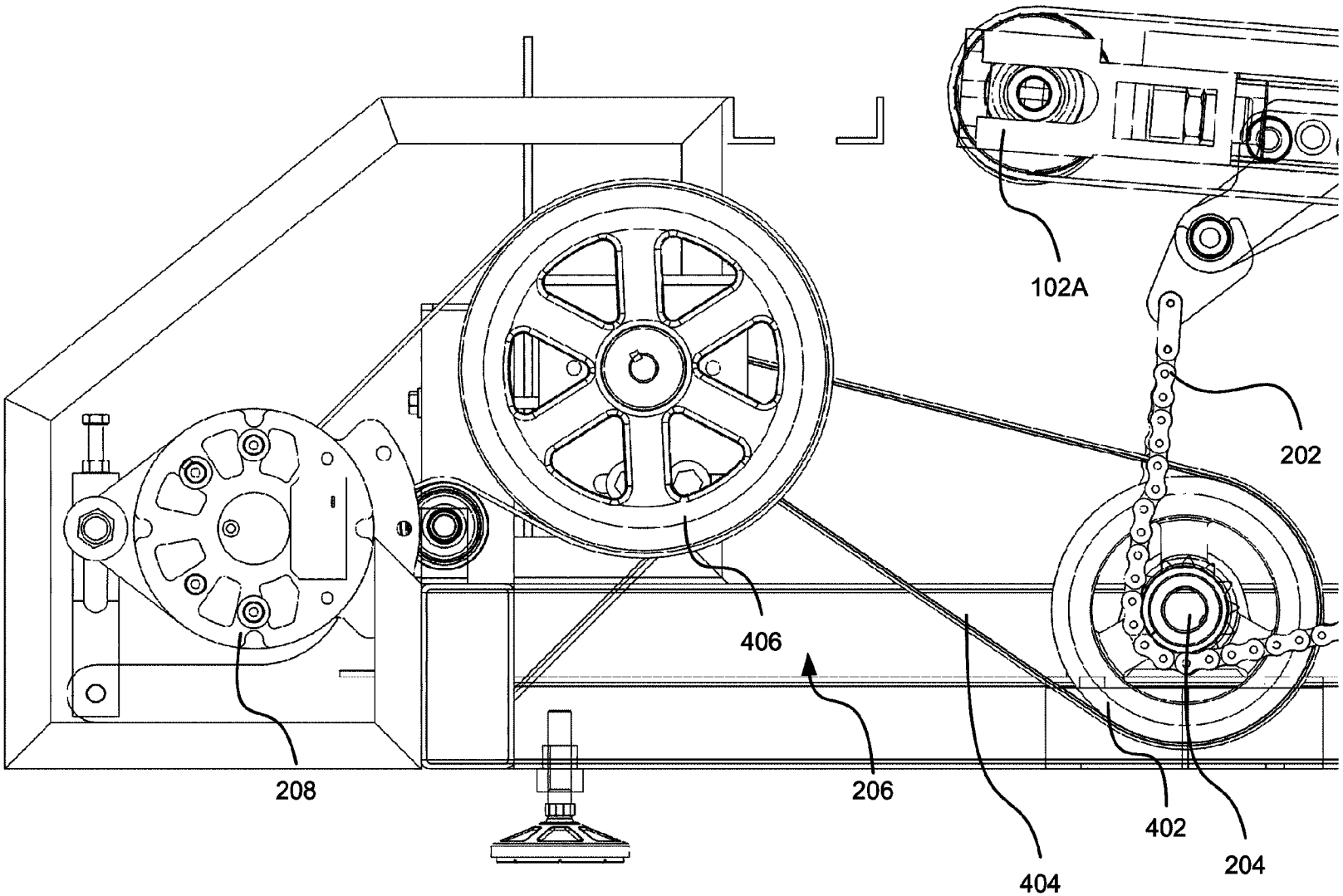
FIG. 4 depicts a side view of one embodiment of the pulley system of FIG. 2.
Figure 5:
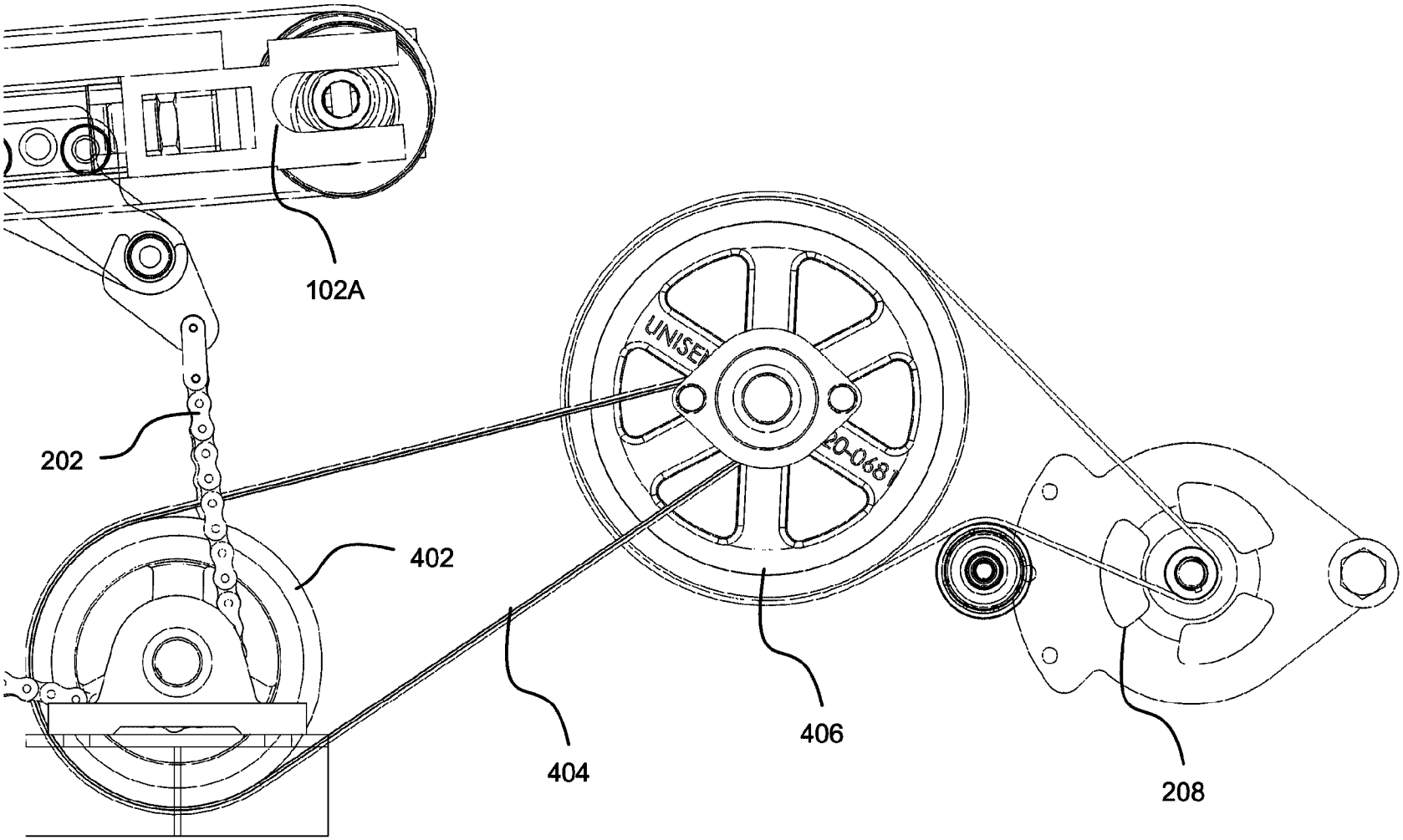
FIG. 5 depicts another side view of one embodiment of the pulley system of FIG. 2.

FIGS. 4 and 5 depict alternate side views of one embodiment of the pulley system 206 of FIG. 2. The pulley system 206 includes one or more pulleys 402, one or more belts 404, and a flywheel 406. The pulley system receives rotational input provided by the clutch axle 204 and provides rotation to the generator 208 at a rate increased over the rate provided by the clutch axle 204.

In some embodiments, the flywheel 406 rotates in response to upward and downward movement of the treadles 102. The flywheel 406 may be located at any point in the pulley system 206. In the illustrated embodiment, the flywheel 406 is located at the intersection of the first stage of the pulley system 206 and the second stage of the pulley system 206. In some embodiments, the flywheel 406 acts as a pulley 402 in the pulley system 206.

The flywheel 406 may act to store inertia in the pulley system 206 and dampen changes in the rate of fall in the treadles 206. The flywheel 406 may be sized to provide desirable dampening characteristics. In one embodiment the flywheel is an eight and one half pound flywheel.

Figure 6:
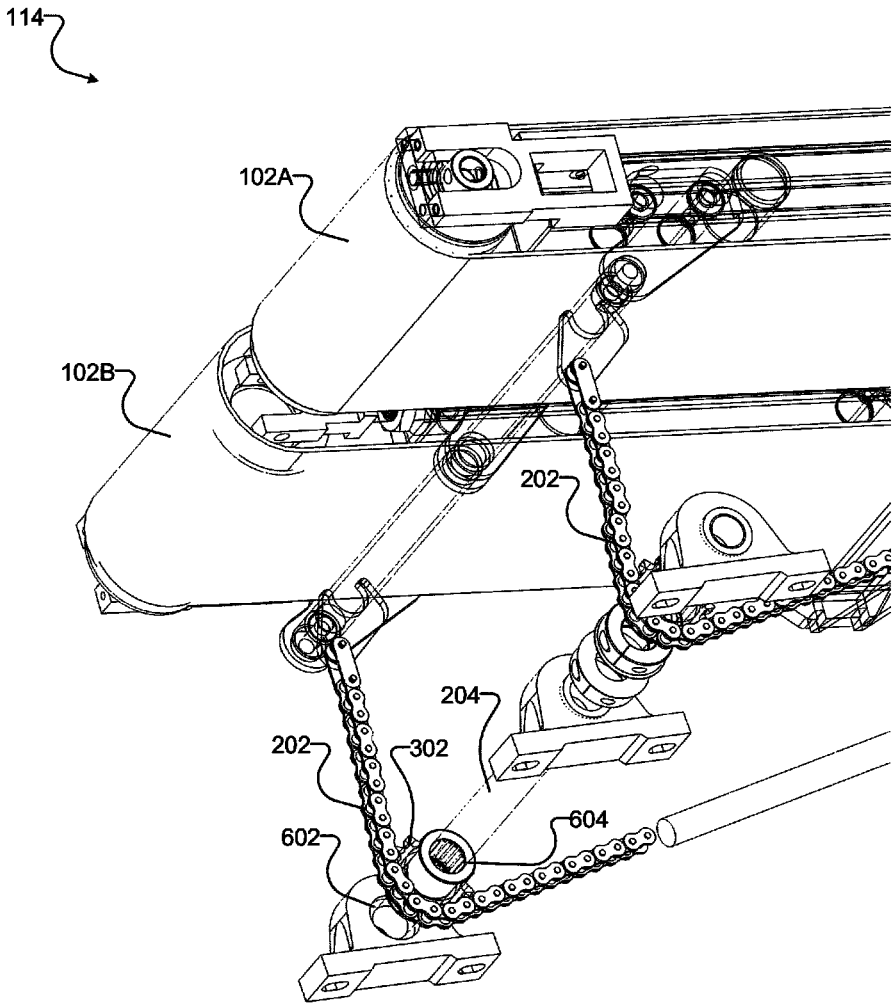
FIG. 6 depicts a perspective view of one embodiment of the clutch axle of FIG. 2.
Figure 7:
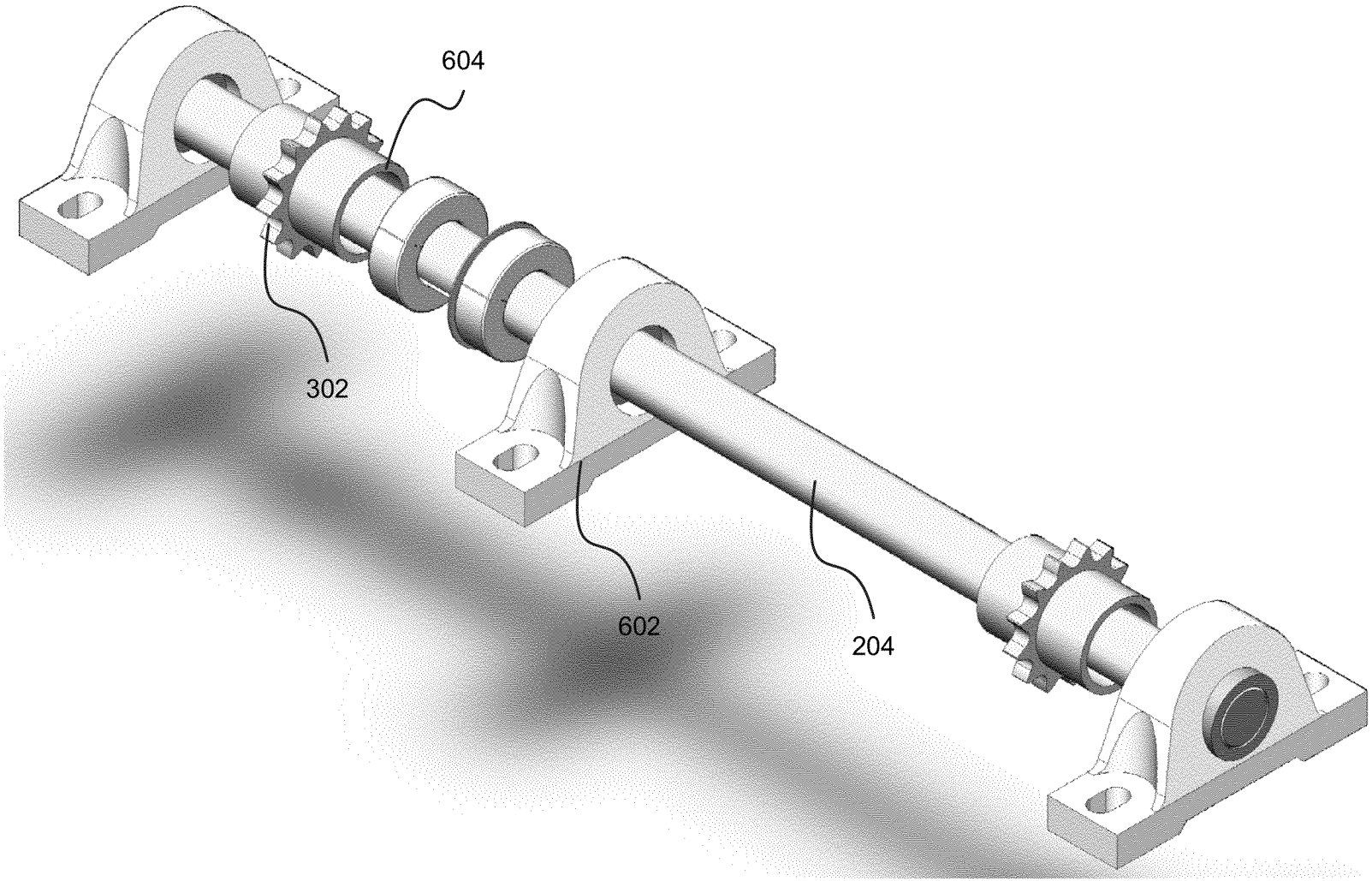
FIG. 7 depicts another perspective view of one embodiment of the clutch axle of FIG. 2.

FIGS. 6 and 7 depict alternative perspective views of one embodiment of the clutch axle 204 of FIG. 2. The clutch axle 204 includes a clutch driver 302, an axle bearing 602, and a clutch 604. The clutch driver 302 is similar to the same numbered object described in relation to FIG. 3. The clutch axle 204 translates linear motion from the drive link 202A to rotary motion.

The axle bearing 602 supports the clutch axle 204 and allows the clutch axle 204 to rotate. The axle bearing 602 may be mounted to a frame of the dual-tread treadmill 100. The axle bearing 602 may be any type of bearing known in the art. For example, the axle bearing 602 may be a roller bearing, a ball bearing, or a plain bearing.

In certain embodiments, the clutch axle 204 is supported by a plurality of axle bearings 602. For example, the clutch axle 204 may be supported by three axle bearings 602.

The clutch 604, in one embodiment, connects the clutch driver 302 to the clutch axle 204. The clutch 604 passes rotation from the clutch driver 302 to the clutch axle 204. The clutch 604 may pass the rotation of the clutch driver 302 to the clutch axle 204 in substantially one direction. For example, the treadmill may include a second drive link 202B similar to the drive link 202A. The clutch 604 may pass rotation from the clutch driver 302 to the clutch axle 204 when the second treadle 102B and the second drive link 202B are moving in an upward direction, but substantially not pass rotary motion to the clutch axle 204 (freewheel) when the second drive link 202B and the second treadle 102B are moving in a downward direction. As a result of the above-described action of the clutch 604, reciprocating movement of the treadles 102 and the drive links 202 will impart rotation of the clutch axle 204 in substantially one direction.

In some embodiments, the clutch 604 passes a braking torque from the clutch axle 204 to the to the clutch driver 302. The braking torque may be created by the generator 208 and passed through the pulley system 206 to the clutch axle 204. In some embodiments, the braking torque is passed by the clutch 604 when the treadle 102B is moving in an upward direction.

The clutch 604 may be any type of clutch known in the art. For example, the clutch may be a one-way clutch, a clutch bearing, a one-way needle, a sprag clutch, a ratchet, a free-wheel, or a slipper clutch.

In some embodiments, the clutch axle 204 includes a second clutch 702. The second clutch 702, in one embodiment, connects a second clutch driver 704 to the clutch axle 204. The second clutch 702 passes rotation from the second clutch driver 704 to the clutch axle 204. The second clutch 702 may pass the rotation of the second clutch driver 704 to the clutch axle 204 in substantially one direction. For example, the second clutch 702 may pass rotation from the second clutch driver 704 to the clutch axle 204 when the treadle 102A and the drive link 202A are moving in an upward direction, but substantially not pass rotary motion to the clutch axle 204 (freewheel) when the drive link 202A and the treadle 102A are moving in a downward direction. As a result of the above-described action of the clutch 604, reciprocating movement of the treadles 102 and the drive links 202 will impart rotation of the clutch axle 204 in substantially one direction.

In some embodiments, motions of the first treadle 102A and the second treadle 102B are mechanically coordinated. For example, in response to a user stepping on the first treadle 102A and causing an end of the first treadle 102A to move downward, a linkage may cause an end of the second treadle 102B to move upward. The linkage may also cause the opposite synchronization such that in response to a user stepping on the second treadle 102B and causing the end of the second treadle 102B to move downward, the linkage may cause the end of the first treadle 102A to move upward.

In certain embodiments, the drive links 202A, 202B and the clutch axle 204 interact such that the clutch axle is driven by a treadle 102 moving in an upward direction. For example, in response to a user stepping on the first treadle 102A, the end of the first treadle 102A moves in a downward direction, the second treadle 102B moves in an upward direction, and the second drive link 202B connected to the second treadle may engage the second clutch 702 to pass rotation to the clutch axle 204. In this manner, a force generated by a user by stepping on a treadle 102 may be converted to rotational motion at the clutch axle 204.

In some embodiments, the clutch 604 passes a braking torque from the clutch axle 204 to the to the clutch driver 302. The braking torque may be created by the generator 208 and passed through the pulley system 206 to the clutch axle 204. In some embodiments, the braking torque is passed by the clutch 604 when the treadle 102B is moving in an upward direction.

The clutch 604 may be any type of clutch known in the art. For example, the clutch may be a one-way clutch, a clutch bearing, a one-way needle, a sprag clutch, a ratchet, a free-wheel, or a slipper clutch.

The clutch axle 204 may interact with the treadles 102A, 102B, the pulley system 206, and the generator 208 such that the generator is driven by reciprocal motion of the treadles 102A, 102B.

Figure 8:
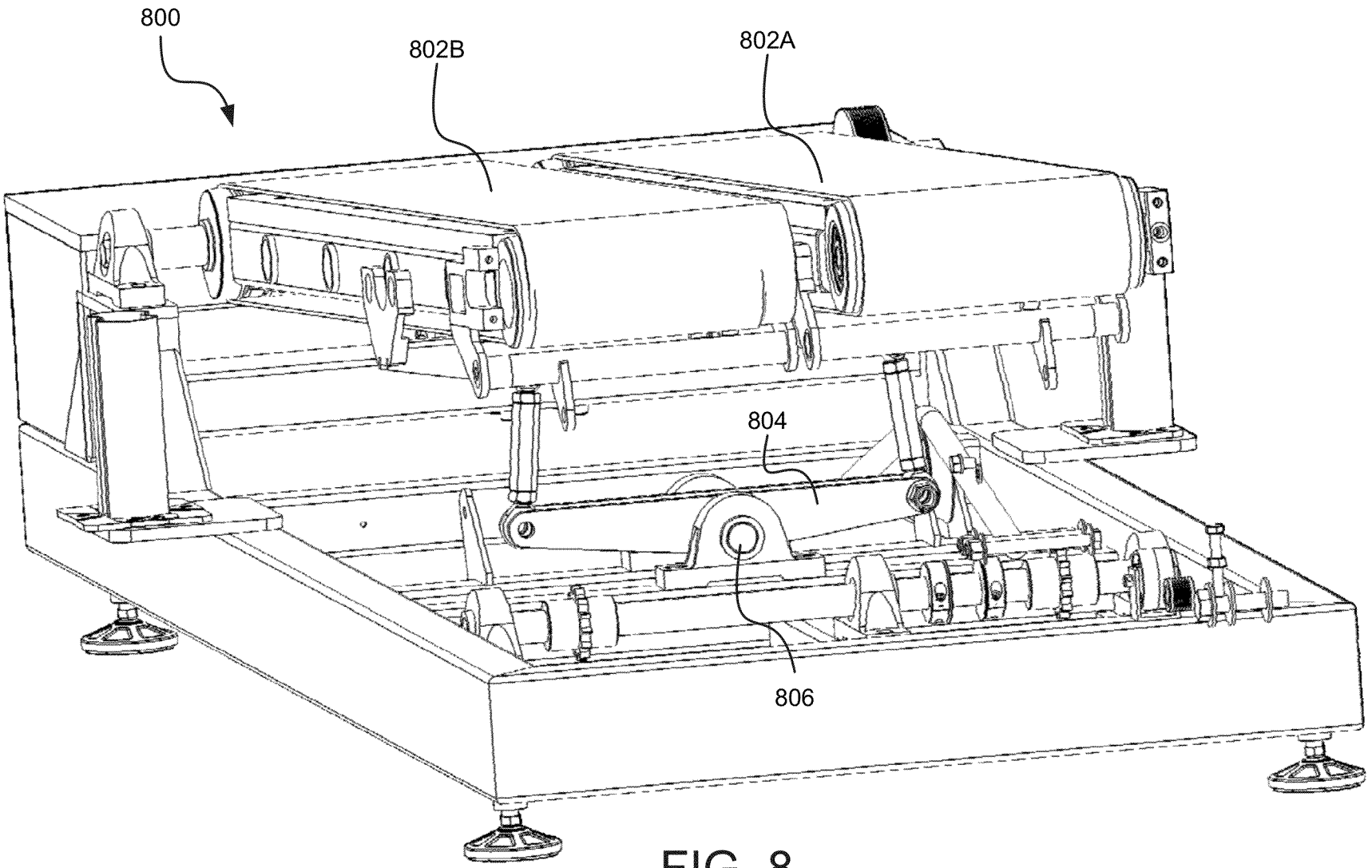
FIG. 8 depicts a perspective view of one embodiment of a rocker drive.

FIG. 8 depicts a perspective view of one embodiment of a rocker drive dual tread treadmill 800. The rocker drive dual tread treadmill 800 includes two treadles 802A, 802B (collectively "treadles" 802), a rocker 802 and a rocker axle 806. The treadles 802 are substantially similar to the treadle 102 described above in relation to FIG. 1. The rocker drive dual tread treadmill 800 translates upward and downward motion of the treadles 802 to rotary motion which is then controlled by an electromechanical braking system.

The rocker 804 is connected to the first treadle 802A near a first end 808 of the rocker 804 and to the second treadle 802B at a second end 810 of the rocker 804. The rocker 804 is connected to a frame of the rocker drive dual tread treadmill 800 at a position disposed between the first end 808 of the rocker 804 and the second end 810 of the rocker 804.

In one embodiment, the connection between the rocker 804 and the frame is a rocker axle 806. The rocker axle 806 allows the rocker 804 to pivot about the rocker axle 806. The rocker axle 806 may include a bearing, such as a roller bearing, a ball bearing, or a plain bearing. In some embodiments, the rocker axle 806 is perpendicular to a treadle axle 812 about which the treadles 802 pivot.

In some embodiments, the rocker 804 will rotate back and forth in a "see saw" motion as the treadles 802 reciprocate upward and downward. The rocker 804 may tie the treadles 802 together such that when one treadle 802A moves in a downward direction, the other treadle 802B moves in an upward direction.

The rocker axle 806, in some embodiments, rotates as the treadles 802 are moved. Rotation of the rocker axle 806 may be passed through an electromechanical braking system to restrict the movement of the treadles 802. For example, the rotation of the rocker axle 806 may be passed through a series of clutches, chains, and/or pulleys to a generator, similar to those described above in relation to FIGS. 1-7. Embodiments of rocker drive mechanisms are further discussed below in relation to FIGS. 11 and 12.

Figure 9:
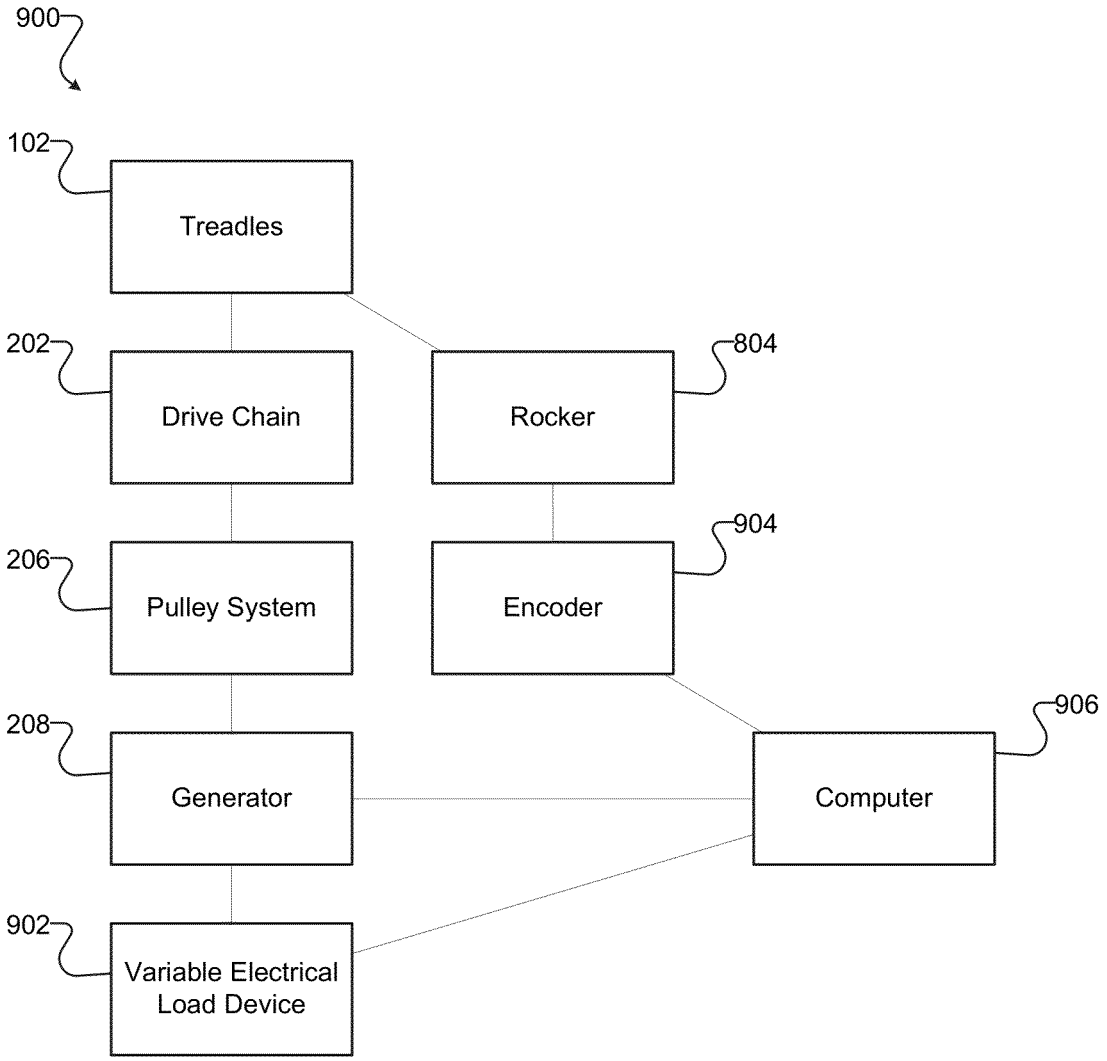
FIG. 9 is a block diagram depicting one embodiment of a system for providing resistance in a dual tread treadmill.

FIG. 9 is a block diagram depicting one embodiment of a system 900 for providing resistance in a dual tread treadmill 100. The system 900, includes two treadles 102, a two drive links 202, a pulley system 206, a generator 208, a variable electrical load 902, a rocker 804, an encoder 904, and a computer 906. The treadles 102, drive links 202, pulley system 206, generator 208, and rocker 804 are substantially similar to the same-numbered components described above. The system 900 provides resistance to treadle 102 articulation in a dual tread treadmill 100.

As described above, in one embodiment, articulation of the treadles 102 causes translation of the drive links 202. Translation of the drive links 202 causes rotation of the pulley system 206. Rotation of the pulley system 206 causes rotation of the generator 208 which produces electrical energy and provides a braking torque back through the mechanical system to the treadles 102.

In some embodiments, the generator 208 is electrically connected to a variable electrical load device 902. The variable electrical load device 902 provides a variable electrical load to the generator 208, causing the braking torque produced by the generator 208 to be increased or decreased. In one embodiment, the variable electrical load device 902 is controlled by a computer 906. The computer 906 may direct the variable electrical load device 902 to increase or decrease an electrical load applied to the generator 208 to increase or decrease the fall rate of the treadles 102. The computer 906 may give this direction in response to a user input, in response to a pre-programmed exercise regimen, in response to direction from a group exercise leader, in response to one or more physical characteristics of the user (e.g. heart rate), or any other trigger.

The variable electrical load device 902 may use any type of variable electrical load. For example, the variable electrical load device 902 may apply a varying resistance to the generator 208 and dissipate the resulting energy as heat. In another example, the variable electrical load device 902 may direct power from the generator 208 to a battery or batteries at a varying rate. In a further example, the variable electrical load device 902 may direct power from the generator 208 to an electrical grid at a varying rate.

In some embodiments, the system 900 includes an encoder 904 that indicates the position of the treadles 102. The encoder 904 may be electrically connected to the computer 906 and provide position information to the computer 906.

The encoder 904 may be any type of encoder known in the art. For example, the encoder 904 may be an optical encoder connected to the rocker 804. In another embodiment, the encoder 904 is a magnetic encoder.

The computer 906, in certain embodiments, determines various parameters related to operation of the system 900, displays information relating to operation of the system 900, and controls aspects of the operation of the system 900. The computer 906 may receive inputs from an encoder 904, the generator 208, or any other component of the system 900. The computer 906 is described in greater detail in relation to FIG. 10.

Figure 10:
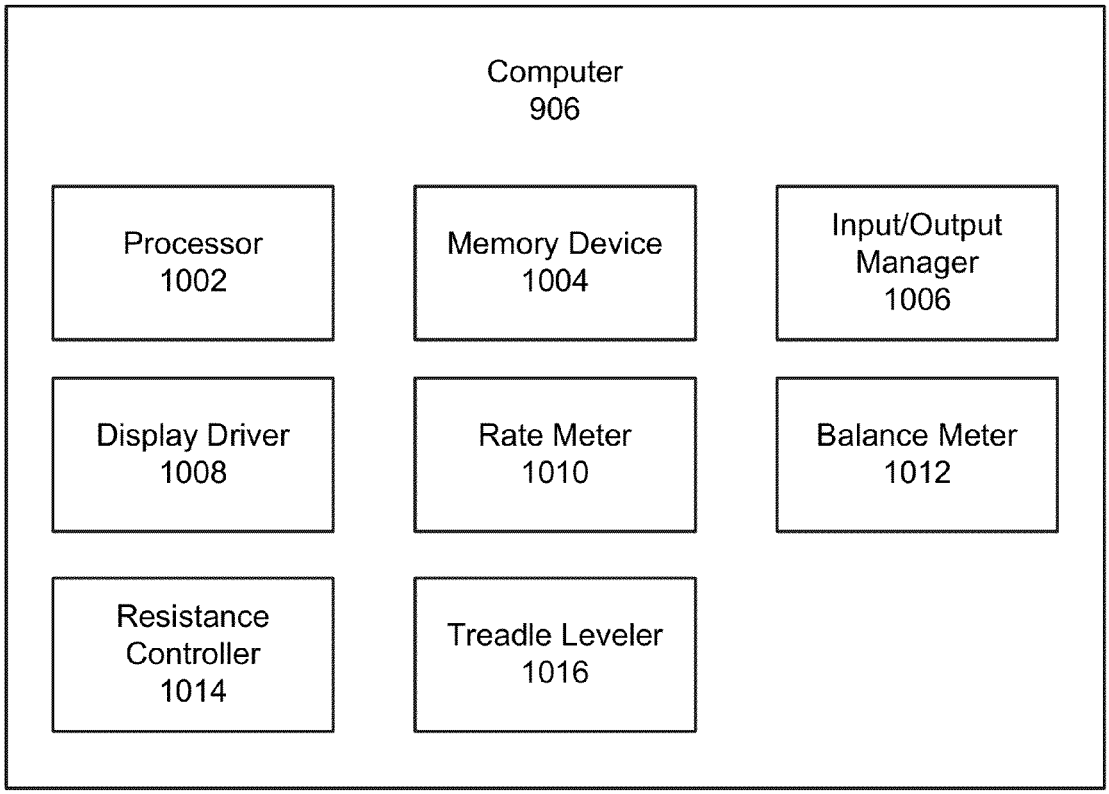
FIG. 10 depicts a flowchart diagram showing one embodiment of a method for providing resistance in a dual treadle treadmill.

FIG. 10 is a block diagram depicting one embodiment of the computer 906 of FIG. 9. The computer includes a processor 1002, a memory device 1004, an input/output manager 1006, a display driver 1008, a rate meter 1010. a balance meter 1012, a resistance controller 1014, and a treadle leveler 1016. The computer 906 determines various parameters related to operation of the system 900, displays information relating to operation of the system 900, and controls aspects of the operation of the system 900.

The processor 1002, in one embodiment, is a hardware component that executes instructions of a computer program. The processor 1002 may be any known or future processor capable of executing the functions of the computer 906. For example, the processor 1002 may be a microprocessor, a central processing unit (CPU) a very-large-scale integration (VLSI) integrated circuit (IC), or a digital signal processor (DSP). The processor 1002 may be programmed to perform the functions of the computer 906.

In some embodiments, the memory device 1004 stores information for use by the computer 906. The memory device 1004 may be any type of known or future computer memory. For example, the memory device 1004 may be or include a volatile memory, a non-volatile memory, random access memory (RAM), flash memory, or a read-only memory (ROM). The information stored by the memory device 1004 may include sensor data, program data, calculated data, user input data, or any other data used by the computer 906.

The input/output manager 1006, in one embodiment, manages inputs of data to and outputs of data from the computer 906. The input/output manager 1006 may include hardware, software, or a combination of hardware and software. Inputs managed by the input/output manager 1006 may include force sensor inputs, RPM sensor inputs, user inputs, or other inputs. Outputs managed by the input/output manager 1006 may include raw outputs and calculated outputs.

The display driver 1008, in some embodiments, controls output of the computer to a display. The display driver 1008 may manage output to one or more LCD, LED, or other displays. For example, the display driver 1008 may control one or more multi-segment LED displays. In another example, the display driver 1008 may control an output to an LCD screen.

In some embodiments, the rate meter 1010 determines a rate at which the system 900 is operated. The rate meter 1010 may receive an input signal that is related to the rate and compute a rate from the input signal. For example, the input signal may be produced by an optical sensor (not shown). In another example, the input signal may be produced by a magnetic sensor (not shown). In another example, the input signal may be produced by the generator 208 that produces electrical power as the exercise apparatus is operated. For example, the generator 208 may produce alternating current with a waveform that has a period related to the rate of operation of the system 900. The period may be related to the rate by gear ratios of the pulley system 206, characteristics of the generator 208, the clutch axle 204, and other parameters. The rate meter 1010 may calculate a rate, such as a cadence rate for steps on the treadles 102 using these relationships.

The rate meter 1010 may determine the rate from the input signal by directing the processor 1002 to perform an operation on the input signal. For example, the processor 1002 may interpret the input signal and apply a calculation based on a gear ratio, sampling rate, or other parameter of the system 900 to determine the rate. In some embodiments, the rate calculated by the processor 1002 may be an estimate of a rate of action by a user of the exercise apparatus is operated, such as cadence, RPM, or speed (such as miles per hour or kilometers per hour).

The balance meter 1012, in one embodiment, determines the relative usage of the first treadle 102A and the second treadle 102B. For example, a user of the system 900 may favor one leg over the other and regularly apply more force or step for a longer period of time on the favored leg. As a result, the treadle 102A used by the favored leg may be on average at a lower position than the treadle 102B used by the non-favored leg. The balance meter 1012 may determine that the average position of the first treadle 102A is lower than that for the second treadle 102B and display this information to indicate that one leg is being favored over the other. The balance meter 1012 may update this information essentially continuously so that the user can adjust usage to balance his or her use of the system 900.

In certain embodiments, the balance meter 1012 receives information about use of the treadles 102 via an encoder 904. The encoder 904 may be attached to any moving component of the system that reflects relative usage of the treadles 102. For example, the encoder 904 may be disposed on the rocker 804 and indicate the angle of the rocker 804. In another example, the encoder 904 may be disposed on the treadles 102.

The resistance controller 1014 may act on the variable electrical load device 902. The resistance controller 1014 may direct the variable electrical load device 902.

Figure 11:
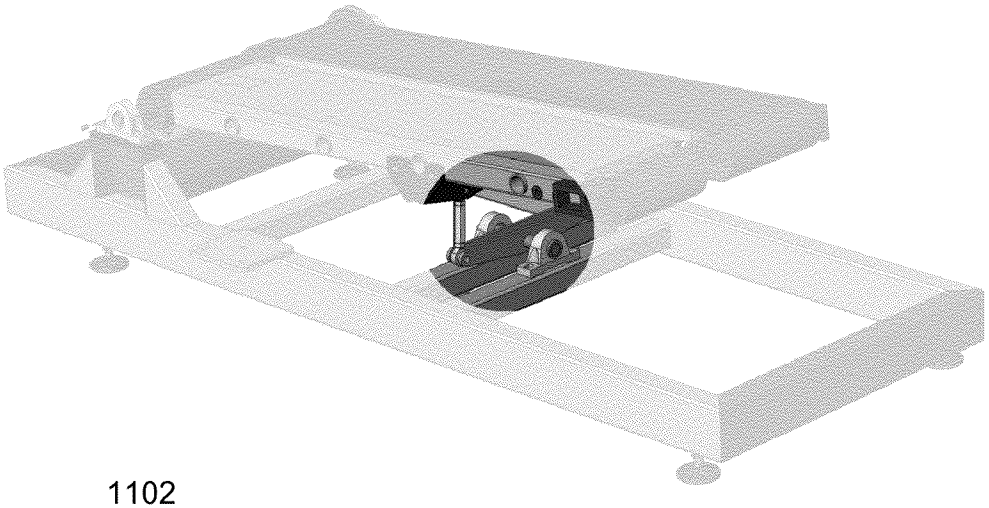
FIG. 11 depicts a perspective view of another embodiment of a rocker drive.
Figure 11:
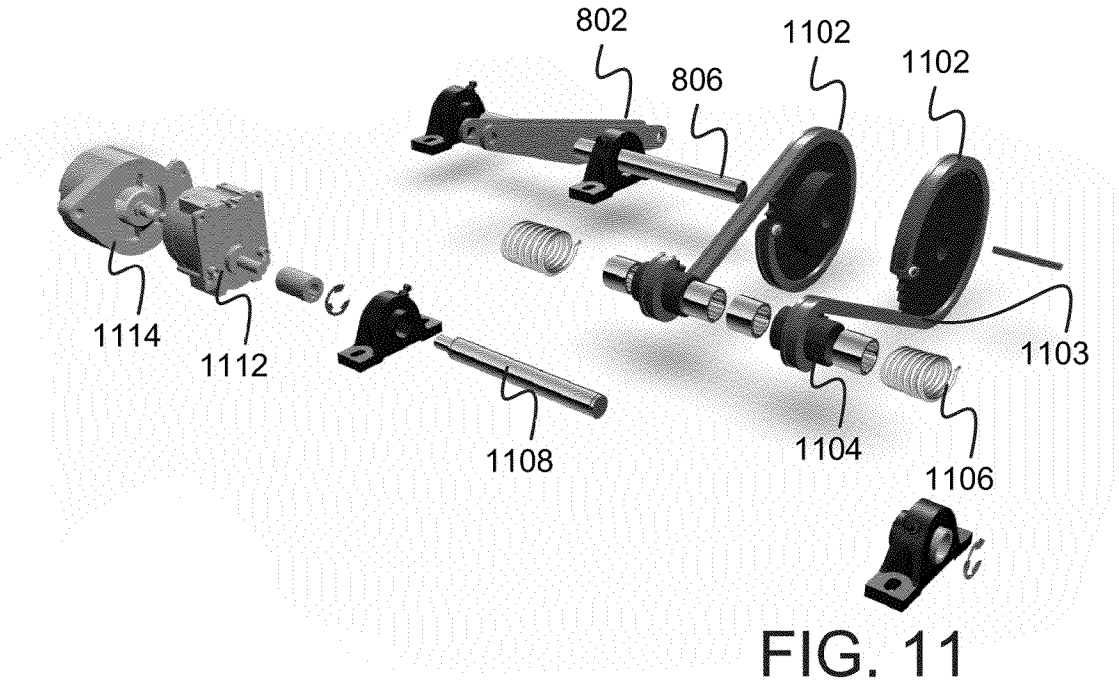

FIG. 11 depicts a perspective view of another embodiment of a rocker drive 1100. The rocker drive 1100 includes a rocker 802, a rocker axle 806, a drive gear 1102, a clutch 1104, a clutch shaft 1108, a gear box 1112 and a generator 1114. In one embodiment, the rocker 802 and the rocker axle 806 are similar to same numbered components described in relation to FIG. 8. The rocker drive 1100 converts the rocking motion of the rocker 802 to electrical energy.

In some embodiments, the various components of the rocker drive system 1100 convert the rocking motion of the rocker 802 to rotary motion, which is translated to the generator 1114. The rotary motion may be transformed to increase or decrease the rate of rotary motion. In some embodiments, several components of the rocker drive 1100 are analogous to components of the system described above in relation to FIGS. 2-7.

The drive gear 1102, in one embodiment, rotates in response to rotation of the rocker axle 806. The drive gear 1102 may exhibit a rocking motion as the rocker 802 rocks. In some embodiments, the rocker drive 1100 includes two drive gears 1102.

The drive gear 1102 may include a drive link 1103. The drive link 1103 may engage the drive gear 1102 and be translated as the drive gear 1102 rotates. In one embodiment, the rocker drive 1100 includes two drive gears 1102, each with an attached drive link 1103. The drive links 1103 may be wrapped around the drive gears 1102 in opposite directions.

In some embodiments, the clutch 1104 receives rotary motion from the drive link 1103 and passes the rotary motion to a clutch shaft 1108. The clutch 1104 may pass rotary motion in only one direction. In some embodiments, the rocker drive 1100 includes two clutches 1104. The two clutches 1103 may interact with two drive links 1103 configured to each allow rotation of the clutch shaft 1108 in the same direction. The resulting output rotation of the clutch shaft 1108 may be rotation in a single direction as the rocker 802 rocks.

One or more springs 1106 may be operable to control rotation of the drive gears 1102, the drive links 1103, and/or the clutches 1104. The springs 1106 may act to prevent or reduce backlash in the rocker drive system 1100.

The gear box 1112, in one embodiment, changes the rate of rotation provided by the clutch shaft 1108 and provides the changed rotation to the generator 1114. The gear box 1112 may be any type of known gear box, including a transmission, a pulley system, and the like. The generator 1114 may be similar to the generator 208 described above. The generator 1114 may be managed and regulated as described above.

Figure 12:
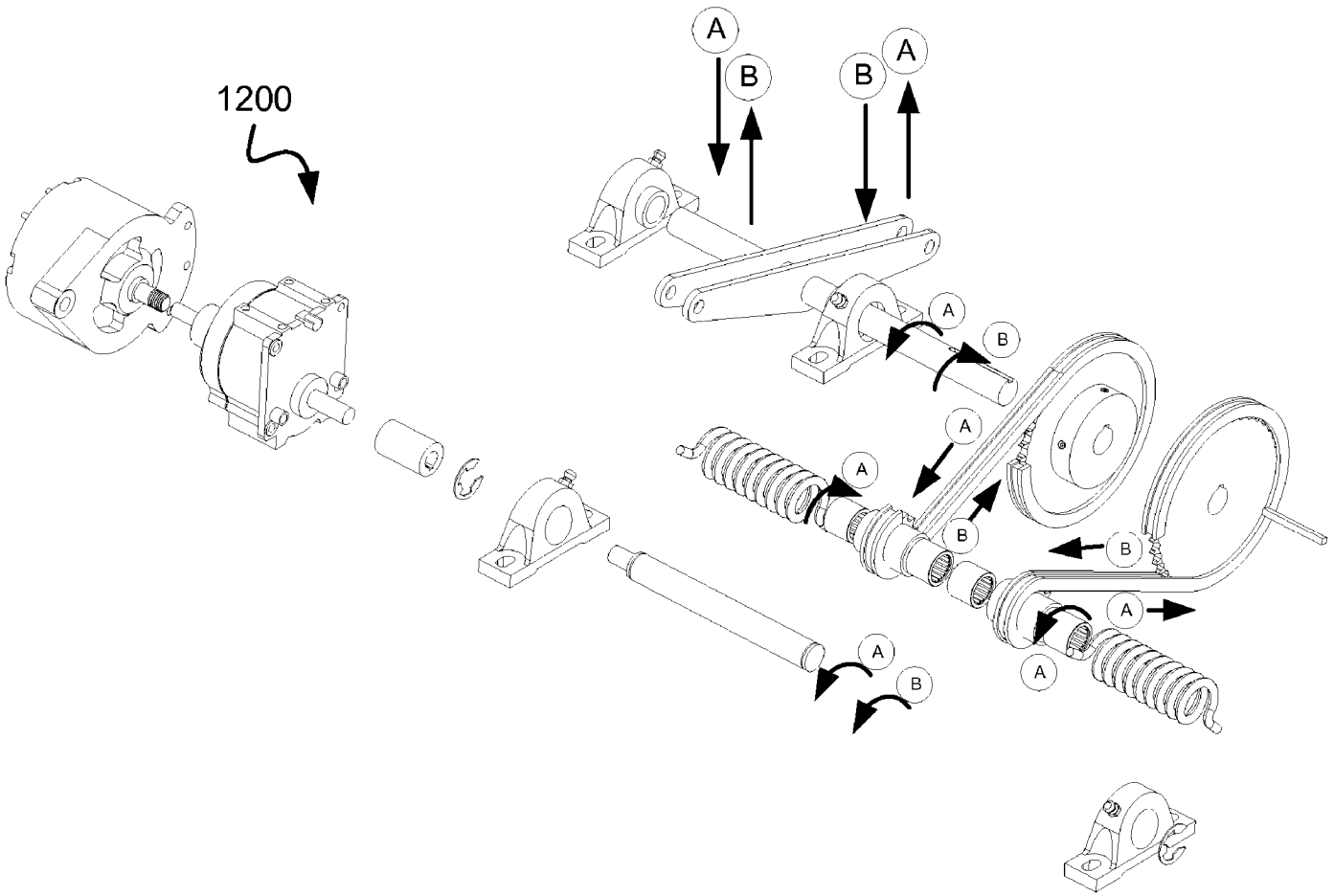
FIG. 12 depicts a perspective view of another embodiment of a rocker drive.

FIG. 12 depicts a perspective view of another embodiment of a rocker drive 1200. The rocker drive 1200 operates as described in FIG. 12 and is similar to the rocker drive 1100 of FIG. 11.

Figure 13:
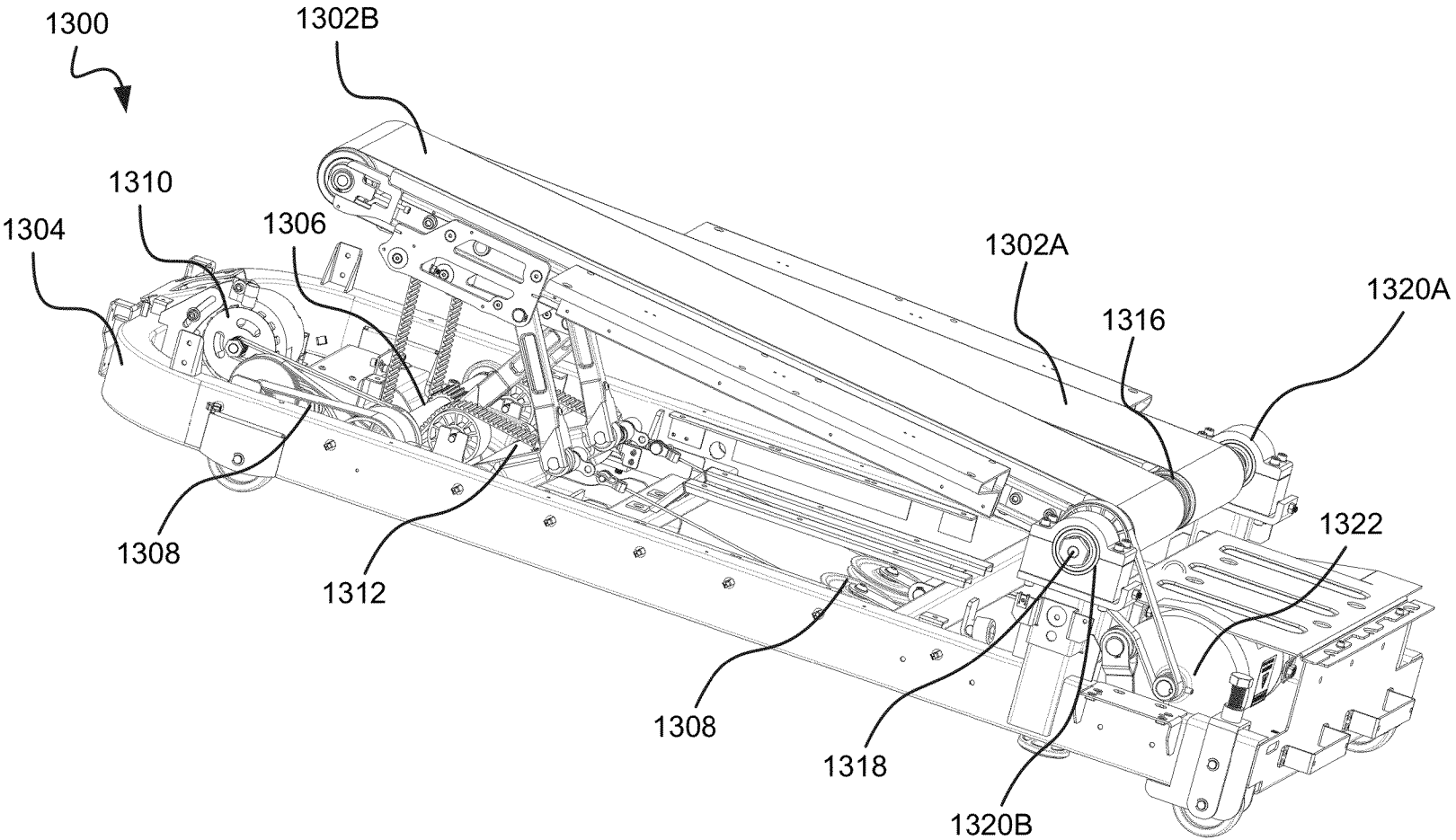
FIG. 13 depicts a perspective view of an alternative embodiment of a dual tread treadmill.

FIG. 13 depicts a perspective view of an alternative embodiment of a dual tread treadmill 1300. The dual tread treadmill 1300 includes a first treadle 1302A, a second treadle 1302B (collectively, "treadles 1300"), a frame 1304, a clutch axle 1306, a transmission 1308, a generator 1310, a rocker 1312, a tensioning mechanism 1314, and a tail roller 1316. In the illustrated embodiment, some components have been removed for clarity. The dual tread treadmill 1300 provides a separate pathway for the travel of each foot of a user.

The treadles 1302, in some embodiments, are pivitolly connected to the frame 1304. The treadles 1302 pivot around a treadle axis 1318. In certain embodiments, the treadle axis 1318 is defined by an axle disposed near a rear end of the treadles 1302. In certain embodiments, the treadle axis 1318 is co-located with the tail roller 1316.

In some embodiments, the tail roller 1316 is rotatably connected to the frame 1304 at a first connection 1320A and a second connection 1320B. The first connection 1320A and the second connection 1320B may be any type of rotatable connection known in the art. For example, the first connection 1320A and the second connection 1320B may be roller bearings, ball bearings, or plain bearings.

The tail roller 1316, in one embodiment, is not supported by the frame between the first connection 1320A and the second connection 1320B. In other words, the tail roller 1316 may span the distance between the first connection 1320A and the second connection 1320B without additional connections to the frame between the first connection 1320A and the second connection 1320B.

In some embodiments, the tail roller 1318 is driven by a motor 1322. The motor 1322 may be operably connected to the tail roller by a drive linkage, such as a belt, a chain, or a gear train. The motor 1322 may be any type of motor known in the art. Operation of the motor 1322 may cause the tail roller 1316 to rotate.

In some embodiments, the tail roller 1316 interfaces with moving surfaces on the treadles 1302. Rotation of the tail roller 1316 may cause the moving surfaces to translate along the treadles 1302.

The frame 1304 provides a structure upon which other components of the dual tread treadmill 1300 are connected. The clutch axle 1306, the transmission 1308, the generator 1310, and the rocker 1312 may perform functions similar to same named components described above and are described in further detail below.

In one embodiment, the rocker 1312 synchronizes motion of the treadles 1302 and rotates around an axis that is parallel to the treadle axis 1318. The rocker 1312 is described in greater detail in relation to FIGS. 14-15B below.

Figure 14:
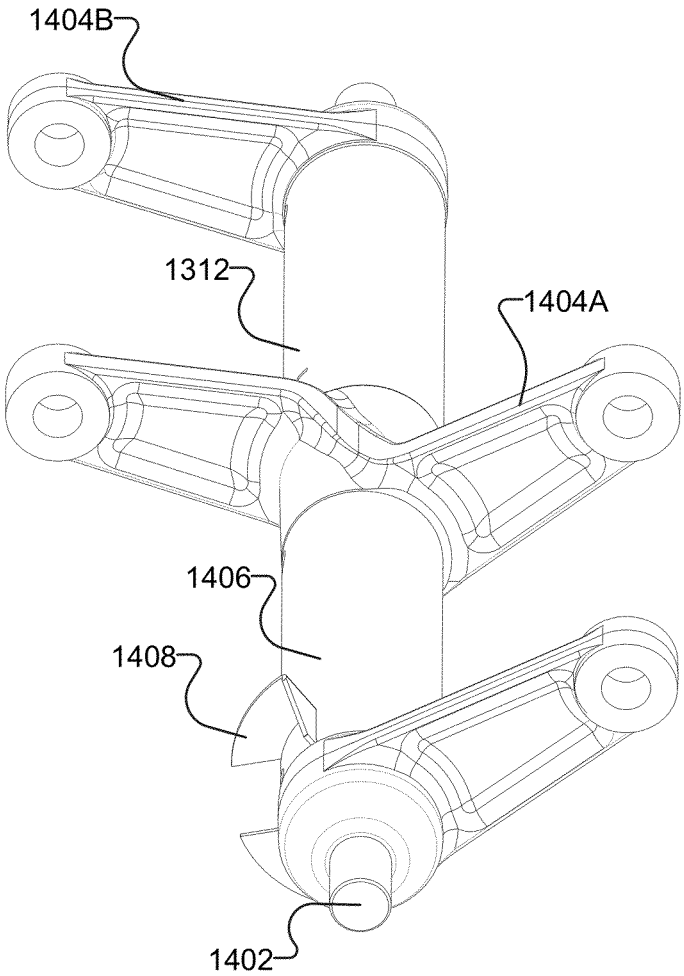
FIG. 14 depicts a perspective view of one embodiment of the rocker of FIG. 13.

FIG. 14 depicts a perspective view of one embodiment of the rocker 1312 of FIG. 13. The rocker 1312 rotates around a rocker axis co-located with a rocker axle 1402. The rocker 1312 is connected to the frame 1304 at the rocker axle 1402. The rocker 1312 synchronizes motion of the treadles 1302 such that as an end of the first treadle 1302A is at its highest point, an end of the second treadle 1302B is at its lowest point. The rocker 1312 also synchronizes motion of the treadles such that as the end of the first treadle 1302A is moving in a first direction, the end of the second treadle 1302B is moving in an opposing, second direction.

In some embodiments, the rocker 1312 includes a plurality of arms 1404. The arms 1404 may include one or more forward facing arms 1404A and one or more rearward facing arms 1404B. The arms 1404 may be in mechanical communication with the treadles 1302.

In one embodiment, the rocker 1312 may include a torque tube 1406. The torque tube 1406 may include a substantially hollow tube configured to transmit the forces applied to the rocker 1312 in operation. The torque tube 1406 may be substantially lighter than a solid body capable of transmitting the same forces.

In one embodiment, the rocker 1312 may include one or more structures capable of being observed by a sensor to indicate the position of the rocker 1312. For example, the rocker 1312 may include one or more flanges 1408 that interact with an optical sensor. One embodiment of a sensor is described in greater detail below in relation to FIG. 16.

Figure 15A:
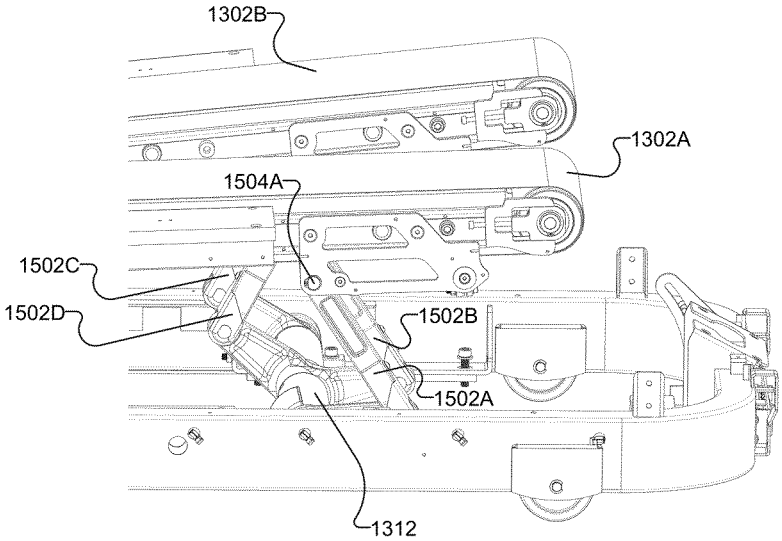
FIGS. 15A and 15B depict perspective cutaway views of one embodiment of the rocker of FIG. 13.
Figure 15B:
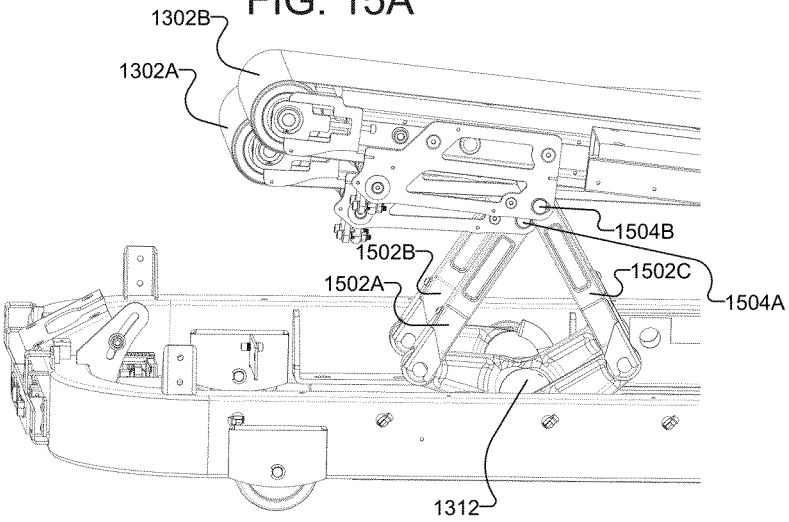

FIGS. 15A and 15B depict perspective cutaway views of one embodiment of the rocker 1312 of FIG. 13. The rocker 1312 is rotatably connected to the frame 1304 and synchronizes the motion of the treadles 1302.

In one embodiment, the first treadle 1302A is connected to the rocker 1312 by a first drag link 1502A. The first drag link 1502A may rotatably connect to the first treadle 1302A at a first connection point. The first connection point may be disposed on a first axle 1504A connected to the first treadle 1302A. The first axle 1504A may be substantially parallel to the treadle axle 1318.

The first drag link 1502A may be rotatably connected to the rocker 1312 on one of the arms 1404 of the rocker 1312. For example, the first drag link 1502A may connect to a forward facing arm 1404A of the rocker 1312. As a result, the first drag link 1502A may connect to the rocker 1312 at a position closer to a forward end of the treadmill than the rocker axis.

The first drag link 1502A translates a pivoting motion of the first treadle 1302A to the rocker 1312. As the first treadle 1302A pivots in a first direction, the first drag link 1502A causes the rocker 1312 to pivot in the first direction.

In some embodiments, the second treadle 1302B is connected to the rocker 1312 by a second drag link 1502C. The second drag link 1502C may rotatably connect to the second treadle 1302B at a second connection point. The second connection point may be disposed on a second axle 1504B connected to the second treadle 1302B. The second axle 1504B may be substantially parallel to the treadle axle 1318.

The second drag link 1502C may be rotatably connected to the rocker 1312 on one of the arms 1404 of the rocker 1312. For example, the second drag link 1502C may connect to a rearward facing arm 1404B of the rocker 1312. As a result, the second drag link 1502C may connect to the rocker 1312 at a position closer to a rearward end of the treadmill than the rocker axis.

The second drag link 1502C translates a pivoting motion of the second treadle 1302B to the rocker 1312. As the second treadle 1302A pivots in a first direction, the second drag link 1502C causes the rocker 1312 to pivot in an opposing, second direction.

In some embodiments, the dual treadle treadmill 1300 includes additional drag links 1502. The additional drag links 1502 may add rigidity to the treadles 1302. For example, in one embodiment, the first treadle 1302A is connected to the rocker 1312 by a first secondary drag link 1502B and the second treadle 1302B is connected to the rocker 1312 by a second secondary drag link 1502D.

The first secondary drag link 1502B and the second secondary drag link 1502D are configured and connected similarly to the first drag link 1502A and the second drag link 1502C, respectively. The secondary drag links 1502B, 1502D may be separated from their corresponding primary drag links 1502A, 1502C by a distance. For example, the first secondary drag link 1502B may be rotatably connected to the first treadle 1302A at a point on the first axle 1504A that is disposed a distance from the first connection point at which the first drag link 1502A is connected. Similarly, the second secondary drag link 1502D may be rotatably connected to the second treadle 1302B at a point on the second axle 1504B that is disposed a distance from the second connection point at which the second drag link 1502C is connected.

Figure 16:
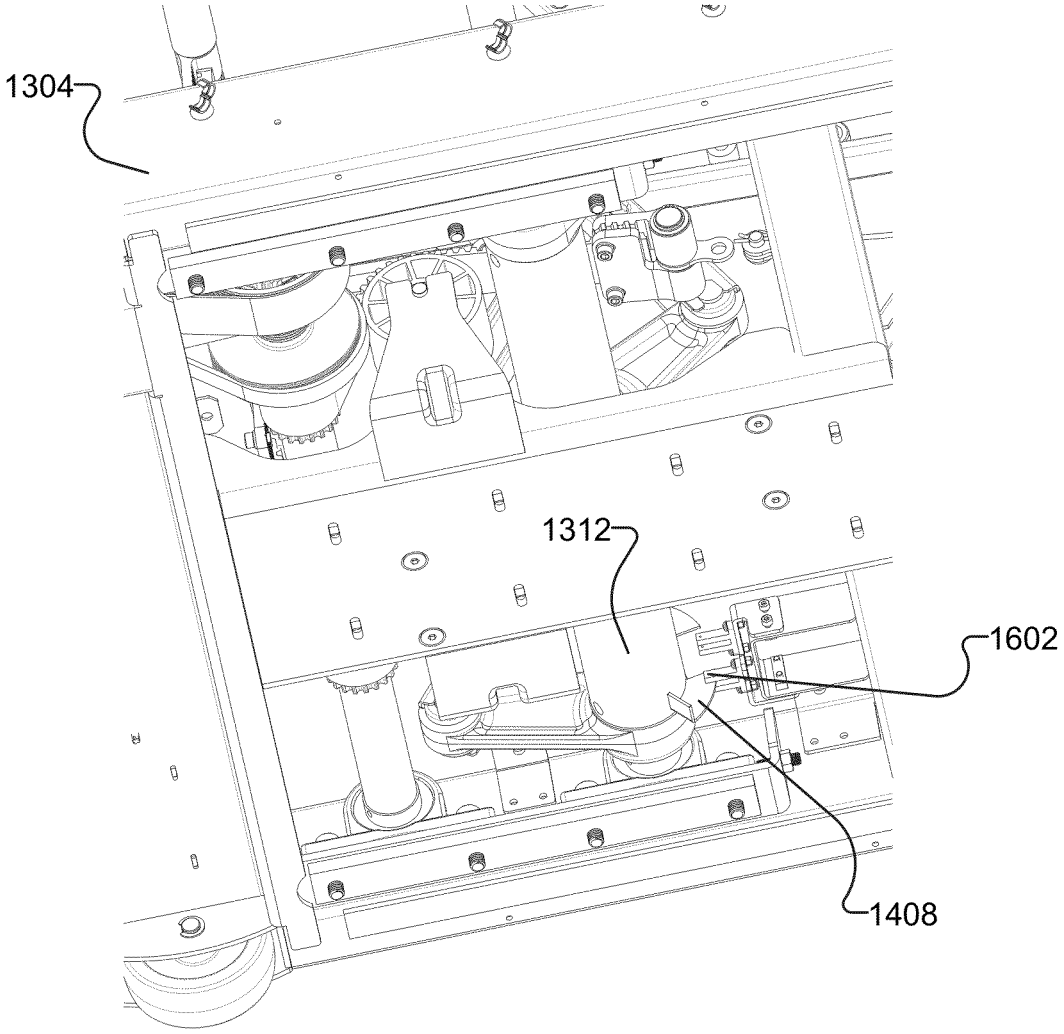
FIG. 16 depicts a cutaway perspective view of one embodiment of the position sensor of FIG. 13.

FIG. 16 depicts a cutaway perspective view of one embodiment of a position sensor 1602 for the dual treadle treadmill 1300 of FIG. 13. The position sensor 1602 includes the position sensor 1602 and an encoder 1408. The position sensor 1602 senses a position of the treadles 1302.

In one embodiment, the position sensor 1602 is attached to the frame 1304. The position sensor 1602 senses a position of the treadles 1302 by sensing an encoder 1408 that changes position as the treadles 1302 move. The sensor 1602 may be any type of sensor known in the art. For example, the sensor 1602 may be an optical sensor or a magnetic sensor.

In some embodiments, the sensor 1602 is an optical sensor and the encoder 1408 includes a flange attached to the rocker 1312. As the rocker 1312 rotates, the position of the attached encoder 1408 changes. The sensor 1602 observes if the encoder 1408 is in a particular position. In response to the encoder 1408 being in a particular position, the sensor 1602 sends a signal to a computer (not shown) to indicate the position of the encoder 1408. The computer may interpret this signal to infer a position of the treadles 1302.

Figure 17:
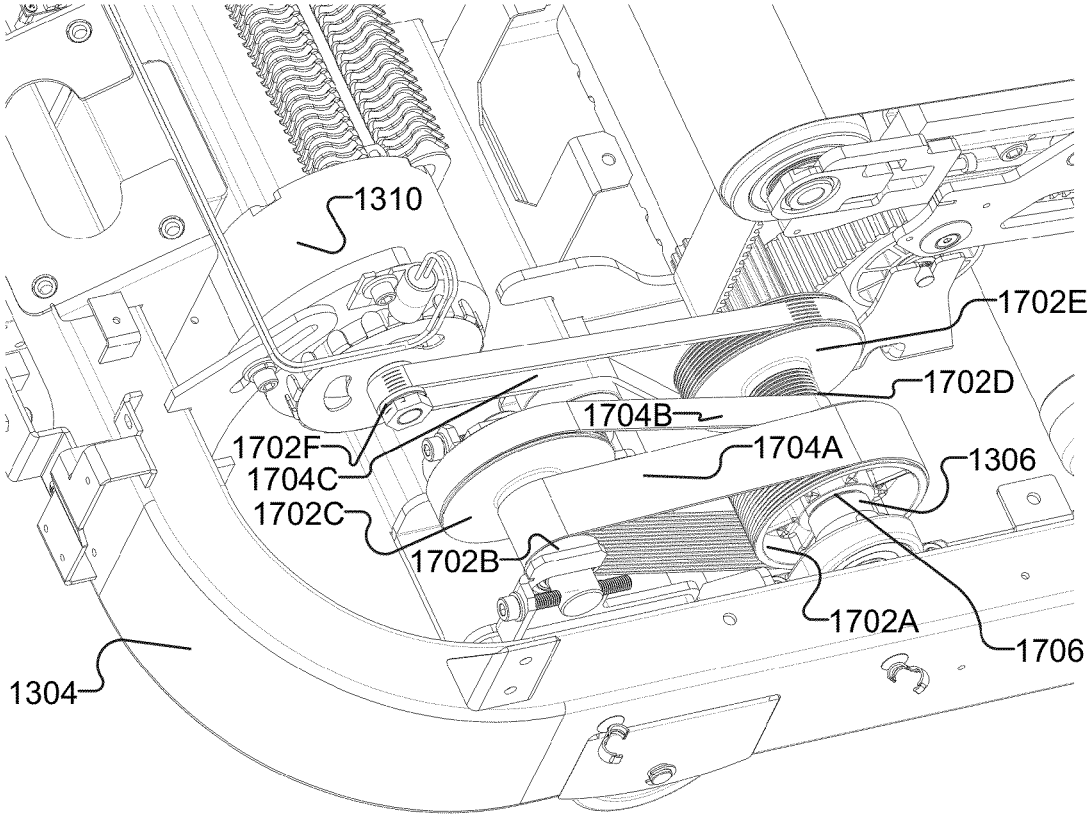
FIG. 17 depicts a cutaway perspective view of one embodiment of the transmission of FIG. 13.

FIG. 17 depicts a cutaway perspective view of one embodiment of the transmission 1308 of FIG. 13. The transmission 1308 includes a plurality of pulleys 1702A-1702F (collectively "pulleys 1702"), and a plurality of belts 1704A-1704C (collectively "belts 1704"). The transmission 1308 changes a rate of rotation and transmits torque from the clutch axle 1306 to the generator 1310.

The pulleys 1702, in one embodiment, include a first pulley 1702A and a second pulley 1702B. The first pulley 1702A is coupled to the axle of the clutch axle 1306. The first pulley 1702A interfaces with a first belt 1704A. The belt 1704A also interfaces with the second pulley 1704B and transfers torque from the first pulley 1702A to the second pulley 1702B.

In one embodiment, the first pulley 1702A and the second pulley 1702B have different diameters so as to produce a gear ratio. In one embodiment, the first pulley 1702A has a larger diameter than the second pulley 1702B, resulting in a higher rate of rotation at the second pulley 1702B than at the first pulley 1702A.

The first pulley 1702A, in certain embodiments, is rigidly attached to the axle of the clutch axle 1306 such that the first pulley 1702A rotates with the clutch axle 1306 and transmits torque to and from the clutch axle 1306. In another embodiment, the first pulley 1702A is connected to the axle of the clutch axle 1306 by a smoothing clutch 1706. The smoothing clutch 1706 may decouple the first pulley 1702A from the clutch axle 1306 in response to the first pulley 1702A spinning at a rate faster than the axle of the clutch axle 1306. Decoupling the first pulley 1702A (and, subsequently, the remainder of the transmission 1308 and the generator 1310) from the clutch axle 1306 (and, subsequently, the treadles 1302), may smooth the motion of the treadles 1302 under certain circumstances and result in a motion that a user may deem more natural.

In some embodiments, the transmission 1308 includes a third pulley 1702C and a fourth pulley 1702D. The third pulley 1702C is coupled to the second pulley 1702B. The third pulley 1702C interfaces with a second belt 1704B. The second belt 1704B also interfaces with the fourth pulley 1704D and transfers torque from the third pulley 1702C to the fourth pulley 1702D.

In one embodiment, the third pulley 1702C and the fourth pulley 1702D have different diameters so as to produce a gear ratio. In one embodiment, the third pulley 1702C has a larger diameter than the fourth pulley 1702D, resulting in a higher rate of rotation at the fourth pulley 1702D than at the third pulley 1702C.

The third pulley 1702C, in certain embodiments, is rigidly attached to the second pulley 1702B such that the third pulley 1702C rotates with second pulley 1702B and transmits torque to and from the second pulley 1702B. In another embodiment, the third pulley 1702C is connected to the second pulley 1702B by a smoothing clutch (not shown). The smoothing clutch may decouple the third pulley 1702C from the second pulley 1702B in response to the third pulley 1702C spinning at a rate faster than the second pulley 1702B. Decoupling the third pulley 1702 (and, subsequently, the remainder of the transmission 1308 and the generator 1310) from the second pulley 1702B (and, subsequently, the treadles 1302), may smooth the motion of the treadles 1302 under certain circumstances and result in a motion that a user may deem more natural.

As will be appreciated by one skilled in the art, the transmission 1308 may have any number of belts 1704 and any even number of pulleys 1702. The transmission 1308 may have one or more smoothing clutches 1706. The transmission may have a smoothing clutch at any interface between pulleys and/or axles. The transmission may produce any desired gear ratio to increase or decrease the speed of rotation produced at the clutch axle 1306.

The belts 1704 may be any type of rotation transmission device known in the art. For example, the belts 1704 may include belts, toothed belts, v-belts, chains, cables, ropes, or the like. The pulleys 1702 may include corresponding structures appropriate to interface with the belts 1704, such as teeth or grooves. The transmission may include any combination of types of belts 1704, such as a first stage poly-v belt and a second stage smooth belt, or belts of differing sizes. In an alternative embodiment, the transmission may include a gear train, a gearbox, a planetary gear, gears, a hydrostatic transmission, a hydrodynamic transmission, or the like.

Figure 18:
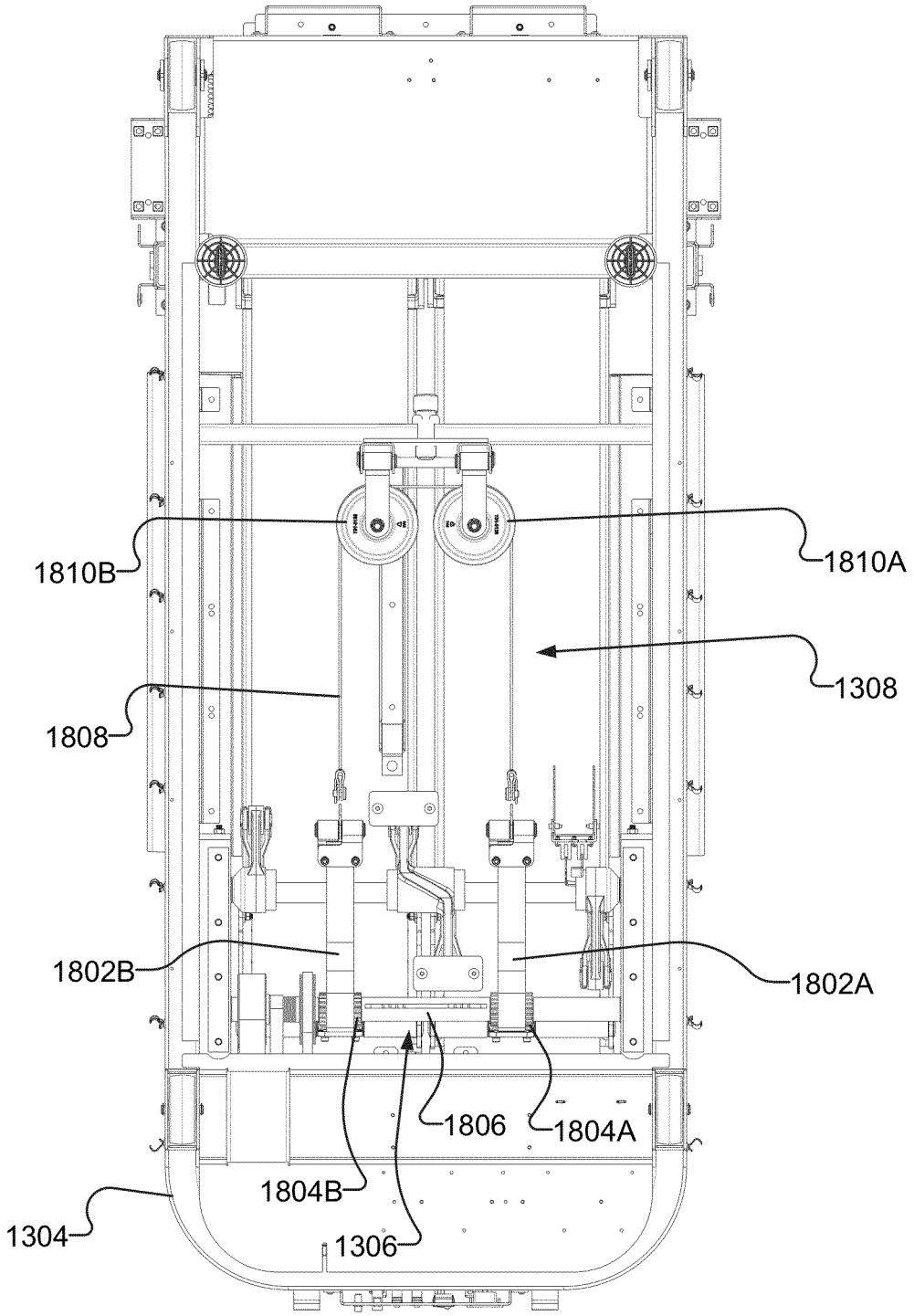
FIG. 18 depicts a bottom view of one embodiment of the tensioning mechanism of FIG. 13.

FIG. 18 depicts a bottom view of one embodiment of the tensioning mechanism 1308 of FIG. 13. The tensioning mechanism includes a flexible linkage 1808 and one or more tensioning pulleys 1810A, 1810B (collectively "1810"). The tensioning mechanism 1308 applies and maintains tension on links 1802A, 1802B (collectively "1802") that transmit motion from the treadles 1302 to the clutch axle 1306.

The links 1802 are connected to the treadles 1302 and interact with drivers 1804A, 1804B (collectively "1804") on the clutch axle 1306 to rotate the drivers 1804. The links 1802 and drivers 1804 may be similar to the drive links and drivers described above in relation to FIGS. 2-7. In some embodiments, the links 1802 are toothed belts and the drivers 1804 include teeth to interface with the teeth on the links 1802.

The links 1802 may be connected to the tensioning mechanism 1308 to maintain tension in the links 1802. In one embodiment, the first link 1802A may be connected to a first end of the flexible linkage 1808. The flexible linkage 1808 may then be routed around a portion of a first tensioning pulley 1810A. A second end of the flexible linkage 1808 may be connected to the second link 1802B. In some embodiments, the first tensioning pulley 1801A is rotatably attached to the frame 1304. The position of the first tensioning pulley 1810A relative to the frame 1304 may be adjustable so as to adjust the tension applied to the links 1802.

In some embodiments, the tensioning mechanism 1308 includes a second tensioning pulley 1810B. The flexible linkage 1808 may be routed around both a portion of the first tensioning pulley 1810A and a portion of the second tensioning pulley 1810B. The second tensioning pulley 1810B may be rotatably attached to the frame 1304 and the position of the second tensioning pulley 1810B may be adjustable relative to the frame 1304 and/or the first tensioning pulley 1810A.

The tension applied to each of the links 1802A, 1802B by the flexible linkage 1808 is substantially parallel. In some embodiments, the force applied by the flexible linkage 1808 to both the first link 1802A and the second link 1802B is substantially directed toward a rear end of the dual treadle treadmill 1300.

The flexible linkage 1808 may be any type of flexible linkage known in the art. For example, the flexible linkage 1808 may be a cable, a rope, a chain, a belt, or the like.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods described herein may be implemented using software instructions stored on a computer useable storage medium for execution by a computer. Embodiments of the invention can take the form of an entirely hardware embodiment, an entirely software embodiment, or an embodiment containing both hardware and software elements. In one embodiment, the invention is implemented in software, which includes but is not limited to firmware, resident software, microcode, etc.

Furthermore, embodiments of the invention can take the form of a computer program product accessible from a computer-usable or computer-readable storage medium providing program code for use by or in connection with a computer or any instruction execution system. For the purposes of this description, a computer-usable or computer readable storage medium can be any apparatus that can store the program for use by or in connection with the instruction execution system, apparatus, or device.

The computer-useable or computer-readable storage medium can be an electronic, magnetic, optical, electromagnetic, infrared, or semiconductor system (or apparatus or device), or a propagation medium. Examples of a computer-readable storage medium include a semiconductor or solid state memory, magnetic tape, a removable computer diskette, a random access memory (RAM), a read-only memory (ROM), a rigid magnetic disk, and an optical disk. Current examples of optical disks include a compact disk with read only memory (CD-ROM), a compact disk with read/write (CD-R/W), and a digital video disk (DVD).

An embodiment of a data processing system suitable for storing and/or executing program code includes at least one processor coupled directly or indirectly to memory elements through a system bus such as a data, address, and/or control bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers. Additionally, network adapters also may be coupled to the system to enable the data processing system to become coupled to other data processing systems or remote printers or storage devices through intervening private or public networks. Modems, cable modems, and Ethernet cards are just a few of the currently available types of network adapters.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A dual treadle treadmill comprising:

a frame;

a first treadle having a first moving surface, the first treadle pivotally coupled with the frame;

a second treadle having a second moving surface, the second treadle pivotally coupled with the frame;

a generator operably associated with the first treadle such that the generator is driven in response to the first treadle pivoting relative to the frame; and a rocker in mechanical communication with the first treadle and the second treadle, the rocker to synchronize the first treadle and the second treadle such that when the first treadle is at its highest position, the second treadle is at its lowest position;

wherein the rocker pivots around a rocker axis parallel to a treadle axis about which the first treadle pivots.

2. The dual treadle treadmill of claim 1, wherein the generator is operably associated with the second treadle such that the generator is driven in response to the second treadle pivoting relative to the frame.

3. The dual treadle treadmill of claim 1, wherein the generator is driven in response to the first treadle pivoting relative to the frame in a first direction, and wherein the generator is not driven in response to the first treadle pivoting relative to the frame in a second direction.

4. The dual treadle treadmill of claim 3, wherein an end of the first treadle moves in a downward direction in response to the first treadle pivoting relative to the frame in the first direction.

5. The dual treadle treadmill of claim 1, wherein the generator is selected from the group consisting of an alternator, a dynamo, a singly-fed generator, and a doubly-fed generator.

6. The dual treadle treadmill of claim 1, wherein the generator is in electrical communication with a variable electrical load device, wherein the variable electrical load device imparts a variable electrical load on the generator.

7. The dual treadle treadmill of claim 6, wherein the variable electrical load device is managed by a computer, and wherein the computer adjusts the amount of electrical load imparted on the generator.

8. The dual treadle treadmill of claim 6, wherein the generator provides a braking torque, and wherein the braking torque is communicated to the first treadle to resist pivoting of the first treadle relative to the frame.

9. A dual treadle treadmill comprising:

a frame;

a first treadle having a first moving surface, the first treadle pivotally coupled with the frame;

a second treadle having a second moving surface, the second treadle pivotally coupled with the frame;

a generator operably associated with the first treadle such that the generator is driven in response to the first treadle pivoting relative to the frame; and a rocker in mechanical communication with the first treadle and the second treadle, the rocker to synchronize the first treadle and the second treadle such that when the first treadle is at its highest position, the second treadle is at its lowest position;

wherein:

the rocker pivots around a rocker axis parallel to a treadle axis about which the first treadle pivots;

the first treadle is connected to the rocker via a first drag link at a first connection;

the first drag link connects to the rocker at a position closer to a frontward end of the dual treadle treadmill than the rocker axis;

the second treadle is connected to the rocker via a second drag link at a second connection;

the second drag link connects to the rocker at a position closer to a rearward end of the dual treadle treadmill than the rocker axis; and the rocker pivots in a first direction and the second treadle pivots in an opposing, second direction in response to pivoting the first treadle in the first direction.

10. The dual treadle treadmill of claim 9, further comprising:

a first secondary drag link connecting between the first treadle and the rocker, the first drag link and the first secondary drag link connected to the first treadle at points along an axis parallel to the rotation axis of the first treadle, the points separated by a distance; and a second secondary drag link connecting between the second treadle and the rocker, the second drag link and the second secondary drag link connected to the second treadle at points along an axis parallel to the rotation axis of the second treadle, the points separated by a distance.

11. A dual treadle treadmill comprising a frame;

a first treadle having a first moving surface, the first treadle pivotally coupled with the frame;

a second treadle having a second moving surface, the second treadle pivotally coupled with the frame;

a generator operably associated with the first treadle such that the generator is driven in response to the first treadle pivoting relative to the frame;

a transmission to transmit force between the first treadle and the generator; and a rocker in mechanical communication with the first treadle and the second treadle, the rocker to synchronize the first treadle and the second treadle such that when the first treadle is at its highest position, the second treadle is at its lowest position;

wherein the rocker pivots around a rocker axis parallel to a treadle axis about which the first treadle pivots.

12. The dual treadle treadmill of claim 11, further comprising a clutch axle comprising:

an axle rotatably connected to the frame;

a first driver coupled to the axle by a first clutch, the first clutch to transmit torque between the first driver and the axle in response to the first driver rotating in a first direction relative to the axle;

wherein the first treadle is in operable communication with the first driver such that the first driver is rotated in a first direction in response to the first treadle being pivoted in the first direction; and wherein the axle is in operable communication with the generator such that torque is transmitted between the axle and the generator.

13. The dual treadle treadmill of claim 12, wherein the first treadle is connected to the first driver through a link selected from the group consisting of a chain, a toothed belt, a belt, and a cable.

14. The dual treadle treadmill of claim 12, wherein:

the clutch axle further comprises a second driver coupled to the axle by a second clutch, the second clutch to transmit torque between the second driver and the axle in response to the second driver rotating in the first direction relative to the axle; and the second treadle is in operable communication with the second driver such that the second driver is rotated in the first direction in response to the second treadle being pivoted in the first direction.

15. The dual treadle treadmill of claim 12, wherein the transmission comprises:

a first pulley coupled to the axle;

a second pulley in communication with the first pulley through a first belt interfacing with the first pulley and the second pulley;

wherein the diameter of first pulley is different from the diameter of the second pulley and rotation of the second pulley is communicated to the generator.

16. The dual treadle treadmill of claim 15, wherein the transmission further comprises:

a third pulley coupled to the second pulley;

a fourth pulley in communication with the third pulley through a second belt interfacing with the third pulley and the fourth pulley;

wherein the diameter of the third pulley is different from the diameter of the second pulley and the diameter of the fourth pulley and rotation of the fourth pulley is communicated to the generator.

* * * * *